US007024821B2

(12) United States Patent
Lu

(10) Patent No.: US 7,024,821 B2
(45) Date of Patent: Apr. 11, 2006

(54) WINDOW WITH MULTI-WAY FOR OPENING

(76) Inventor: Zhongxuan Lu, Room 401, Sectionn 1. Zonghe Building 9-1, Xinhua Street, Nanning, the Guangxi Zhuang Autonomous Region (CN)

( * ) Notice: Subject to any disclaimer, the term of this patent is extended or adjusted under 35 U.S.C. 154(b) by 0 days.

(21) Appl. No.: 10/192,042

(22) Filed: Jul. 10, 2002

(65) Prior Publication Data

US 2003/0014920 A1 Jan. 23, 2003

(30) Foreign Application Priority Data

Jul. 18, 2001 (CN) ..... 01231708 U

(51) Int. Cl.
*E05D 15/08* (2006.01)

(52) U.S. Cl. ..... 49/177; 49/158; 49/425; 49/345; 49/339

(58) Field of Classification Search ..... 49/176, 49/152, 177, 125, 175, 142, 143, 158, 425, 49/403, 411, 394, 395, 396, 420, 246, 247, 49/248, 249, 252, 343, 345, 346, 342, 339; 292/263, 35, 36, 139, DIG. 46; 16/370, 16/369, 371, 366, 47, DIG. 27
See application file for complete search history.

(56) References Cited

U.S. PATENT DOCUMENTS 1,106,791 A * 8/1914 Eklund ..... 49/248
1,387,573 A * 8/1921 Wilson ..... 292/36
1,552,723 A * 9/1925 Mielenz ..... 49/248
1,628,473 A * 5/1927 Pokorney ..... 292/36
3,027,606 A * 4/1962 Nicklas ..... 49/260
3,090,084 A * 5/1963 Banner ..... 49/420
3,208,109 A * 9/1965 Buck, Jr. ..... 49/425
3,208,111 A * 9/1965 Grossman ..... 49/425
3,416,183 A * 12/1968 Martin ..... 16/105
3,633,389 A * 1/1972 Horgan, Jr. ..... 70/120
3,680,901 A * 8/1972 Biebuyck ..... 292/36
3,722,142 A * 3/1973 Anderberg et al. ..... 49/248
3,993,338 A * 11/1976 Cherbourg et al. ..... 292/336.3
4,222,201 A * 9/1980 Yanessa ..... 49/189
4,263,795 A * 4/1981 Van Gompel ..... 70/99
4,282,631 A * 8/1981 Uehara et al. ..... 16/102
4,286,716 A * 9/1981 Budich et al. ..... 206/577
4,362,328 A * 12/1982 Tacheny et al. ..... 292/36
4,423,895 A * 1/1984 Mosley, Jr. ..... 292/36

(Continued)

FOREIGN PATENT DOCUMENTS

CN 2358194 1/2000

(Continued)

*Primary Examiner*—Gregory J. Strimbu
(74) *Attorney, Agent, or Firm*—Greer, Burns & Crain, Ltd.

(57) ABSTRACT

A window that can be opened in multiple manners such as pushing/pulling and rotating outwards by using a sliding pipe assembly, includes a frame assembly and at least two sash assemblies. A horizontal frame in the frame assembly has a cavity with an opening, a guide track mounted on a bottom slab of the horizontal frame cavity, and a pair of subsidiary guide tracks provided on a pair of side slabs of the horizontal frame cavity. Several roller devices are arranged along the sliding pipe assembly and matched with the guide track and subsidiary guide tracks of the horizontal frame. Therefore, the sliding pipe assembly can be moved along the horizontal frame. Furthermore, a hinge assembly fastened to the sliding pipe assembly is provided in one of several stiles of each of the sash assemblies to be used for supporting rotation of the sash assemblies.

30 Claims, 18 Drawing Sheets

U.S. PATENT DOCUMENTS 4,445,717 A * 5/1984 Imhoff ..... 292/177
4,587,760 A * 5/1986 Brissette ..... 49/252
4,590,707 A * 5/1986 von Resch ..... 49/130
4,633,615 A * 1/1987 Moose ..... 49/425
4,643,005 A * 2/1987 Logas ..... 70/95
4,828,299 A * 5/1989 Poe ..... 292/139
4,833,829 A * 5/1989 Wilson ..... 49/426
4,888,915 A * 12/1989 Goldenberg ..... 49/181
4,967,507 A * 11/1990 Visnic et al. ..... 49/504
4,991,886 A * 2/1991 Nolte et al. ..... 292/161
5,037,230 A * 8/1991 Aumercier ..... 403/53
5,058,321 A * 10/1991 Harbom et al. ..... 49/177
5,118,145 A * 6/1992 Tucker ..... 292/158
5,375,894 A * 12/1994 Schlack ..... 292/36
5,649,388 A 7/1997 Best et al.
5,649,389 A * 7/1997 Coddens ..... 49/419
5,689,916 A * 11/1997 Jensen et al. ..... 49/252
5,791,700 A * 8/1998 Biro ..... 292/7
5,829,802 A * 11/1998 Anderson et al. ..... 292/336.3
5,836,111 A 11/1998 Tak
5,898,977 A * 5/1999 Muir ..... 16/363
5,927,014 A * 7/1999 Goldenberg ..... 49/182
6,230,457 B1 * 5/2001 Brautigam ..... 52/204.69
6,233,888 B1 * 5/2001 Wu ..... 52/207
6,276,092 B1 * 8/2001 Neo ..... 49/183
6,314,681 B1 * 11/2001 Moody ..... 49/343
6,701,994 B1 * 3/2004 Goldenberg et al. ..... 160/31

FOREIGN PATENT DOCUMENTS

GB 2 150 190 6/1985

* cited by examiner

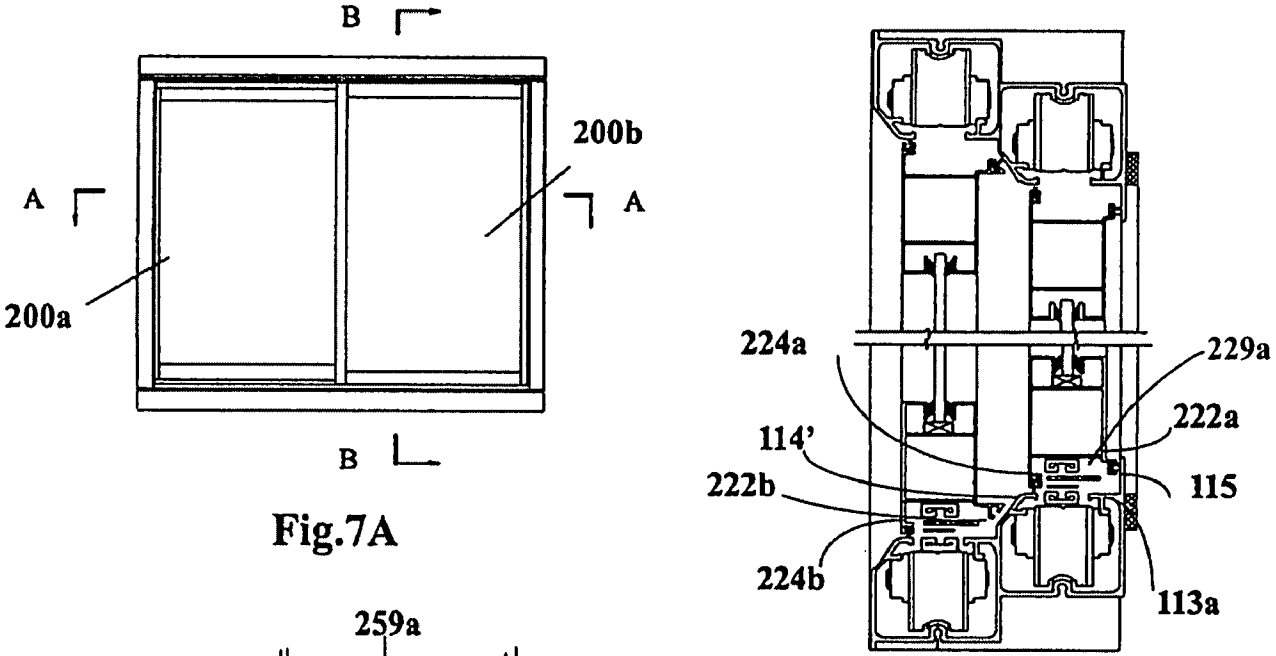
Fig.7B
Fig.7A
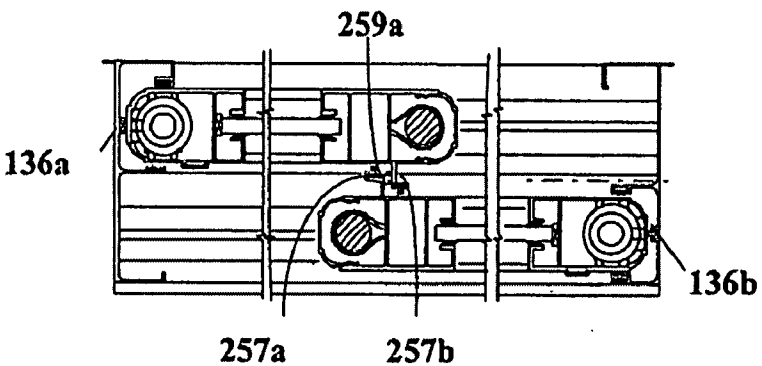
Fig.7C

WINDOW WITH MULTI-WAY FOR OPENING

TECHNICAL FIELD OF THE INVENTION

The invention relates to a window for building construction, more particularly, to a window that can be opened in multiple manners such as pushing/pulling, and rotating outwards by using a sliding pipe assembly or the like.

BACKGROUND OF THE INVENTION

Windows in modern architecture are provided with improved transparent and ventilation properties. The window designs commonly seen in the prior art can be rotated outwards or can be pushed/pulled along the slide tracks. However, both of the above types of prior art windows have their advantages and drawbacks. For example, a push and pull window has an attractive appearance and no space is occupied for it to open, but it has a small open region so as to lead to unsatisfied indoor lighting and air ventilation. The rotated window has some advantages such as a large open region, simple structure, and convenience in fabrication and installation. However, this type of window is unable to achieve desired air guide characteristics due to the restriction of its outward rotation angle. In addition, rotated windows have relatively poor stability, which can be shown by the fact that the dropping-out of the sash under windy conditions is frequent. Moreover, the above-mentioned two types of windows in the prior art commonly have unsafe and inconvenient problems in cleaning of outside on the sash and experience disability in guiding the air.

In the aspect of materials, aluminum alloy, insulating shaped aluminum or plastic steel laminate, etc. are commonly used in modern windows. However, these three kinds of construction materials have their defects. The aluminum alloy material has a higher heat-transfer character, and it is easily susceptible to dew during the winter season. Plastic steel laminate has poor weather stability and dirt resistance. Therefore, the plastic steel laminate is easily deformed and discolored in regions with greater temperature variations, which leads to degradation of its sealing performance. Application of the insulating shaped aluminum requires a large quantity of material and high costs so it is typically not suitable for widespread use.

SUMMARY OF THE INVENTION

An object of the invention is to provide a window with double track frame elements, wherein a slide pipe mounted on the sash assembly is configured for sliding along the frame element and is matched with the guide track disposed respectively on the double track frame to facilitate the opening and closing of the window by pushing and pulling. The hinge assembly mounted in the stile of the sash assembly allows the window assembly to be opened outwards at any angle in all positions of its push and pull travel, while the outward rotating angle can reach 180 degrees.

The present invention provides a window that can be opened in multiple manners, including a frame assembly configured for being fastened in a window opening, a pair of parallel horizontal frame sections spaced apart from each other by a distance, each having a predefined length, and a pair of vertical frame sections each having a predefined length and installed in parallel between the pair of horizontal frame sections to form an enclosed frame. The window also includes at least two sash assemblies configured for receiving a glass medium and corresponding with the frame assembly to facilitate closing and opening of the window, the sash assemblies each having a pair of rails for matching with the pair of horizontal frame sections, and at least two stiles configured for matching with the pair of vertical frames frame sections and arranged to be perpendicular to the rails to form an enclosed sash. Each horizontal frame section includes two horizontal frames which are installed in parallel, each of which forms a cavity with a top opening, a guide track provided on a bottom slab of the horizontal frame, and a pair of subsidiary guide tracks located at both sides of the guide track and fastened onto one of the slab and a top of the horizontal frame. The window further includes a pair of sliding pipe assemblies matching with each sash assembly, each of which includes a sliding pipe configured for sliding along the cavity of the horizontal frame. Several roller devices are arranged along the sliding pipe, one of which includes a roller seat fastened to the sliding pipe via location holes on a top of the sliding pipe, wherein an opening is provided on a bottom of the roller seat; and a pair of sliding slots are respectively provided on two side sections of the roller seat and are aligned with each other, and a roller support, mounted in the roller seat and fastened to the sliding pipe via the location holes on the top of the sliding pipe, wherein an opening is provided on the bottom, and a mounting hole is provided on each side section and is aligned with the sliding slot. The roller device further includes a main roller corresponding with the guide track provided on the bottom slab and fastened to the sliding slots of both sides of the roller seat through a pivot, two subsidiary rollers corresponding with the pair of subsidiary guide tracks and symmetrically provided on outsides of both sides of the roller seat, and a regulator penetrating through the top of the sliding pipe and the roller seat and pressing on the top of the roller support for adjusting vertical separation between the main roller and the subsidiary rollers. The window further includes a hinge assembly, fastened on the sliding pipe, for installation in one of the stiles to sustain rotation of the sash.

The parallel-installed horizontal frames are staggered, and an outer side slab of each horizontal frame is provided with a slant part for inclining inwards to be used to connect to an opening in the top slab. A pair of subsidiary guide tracks is provided in the cavity of the horizontal frames and fastened onto the side slab/top slab of the horizontal frame.

A location device provided on the sliding pipe includes a bolt matching with a location hole on the slide pipe and extending into the sliding pipe, and a pressed-block provided at the end of the bolt, having a recess to match with the guide track of the horizontal frame, configured for adjusting tightness and fastening the sliding pipe assembly.

A rotary arm assembly matching with each sash assembly is used for supporting the window when it opens outwards and is provided with a first slideway fastened on the top of the sliding pipe, in which a first slide block is provided, and a second slideway fastened to the bottom of the sash, in which a second slide block is provided. The rotary arm assembly also includes a stand bar having a first end and a second end, wherein the first end is hinged with the first slideway and the second end is hinged with the slide block inside the second slideway, and a pivoted arm having a first end and a second end, wherein the first end is hinged with a pre-determined position of the stand bar and the second end is hinged with the first slide block inside the first slideway. The stand bar is particularly provided as a curvilinear swell from both ends to the middle, extending outwards. A sliding block knob is needed to stop the first slide block.

The hinge assembly to be adapted with the sash assembly further includes a hinge sleeve provided in the stile, rotating relative to the hinge and integrally provided with a sleeve configured for insertion by the hinge, and a rod provided in the rail for bringing the sash assembly into rotation. The top of the hinge assembly is fastened by a sleeving, and then an axial bush is inserted by the hinge to be used for supporting the hinge sleeve.

At least one locking pin assembly is provided in an end of the other stile and includes a base frame with a keyway having a base formed at an inner part of the keyway and protruding from an inside wall. The locking pin assembly also includes a pin element with a cavity provided with a body for being adapted with the base, on which a protrusion is provided at an outer end for being associated with an outer part of the keyway, and a body extension penetrating through a central hole on a top of the base frame. The locking pin assembly further includes a spring provided at the inner part of the keyway configured for pressing on the protrusion of the pin element and resetting the pin element, and a movable block sliding along the cavity of the pin element and pulled by bracing wires.

A handle means for locking is used to adapt with the locking pin assembly for locking the window and includes a platen provided at a predefined position on the outer surface of the stile, a recess provided at the front of the platen, a supporting seat located at an end of the recess, and a rotary handle for locking, adapted with the recess and fastened onto the supporting seat utilizing a flat shaft. The handle means also includes a rotary bracket provided at the inner surface of the platen and configured for matching with the flat shaft in order to link following the rotary handle, the bracket including two cavities with parallel-installed openings, on each of which a penetrating slot is provided for arranging the bracing wires connected to the moving block inside the cavity of the pin element, and a roller means fastened onto the back of the platen via a support, by which a moving block is connected to the handle.

According to an aspect of the invention, since the sliding pipe assembly is applied in the invention, the window thus can be simultaneously opened outwards while the sash is being pushed/pulled. Thus, the user may optionally adjust the open region and angle within the range of the window. The indoor air input and air inlet direction may be adjustable thereby.

According to another aspect of the invention, the application of the present rotary arm assembly allows the window to open outwards and rotate at 180 degrees. Thus, it is convenient for the user to facilitate indoor cleaning on both sides of the window and air guide function. Therefore, dangerous operations while cleaning the windows of buildings have been ideally avoided.

According to a further aspect of the invention, since the location pin assembly is provided in both top and bottom ends of the stile in the invention, it ensures that the window of the invention can be slowly inserted into the recess for closing and prevent the window glass from being broken in windy conditions. On the other hand, because four corners of the present sash assembly are respectively locked while closing, its sealing and anti-theft performance is excellent.

According to a further aspect of the invention, when a layer of plastic sectional material, e.g. PVC material, is coupled with the inside of the window, not only may the rigidity requirement of the window be met, but also sound or thermal insulation and heat reserving effects can improve.

BRIEF DESCRIPTION OF THE DRAWINGS

The present invention will become more apparent as the disclosure of the present invention is made with reference to the accompanying drawings.

FIG. 7A is a front view of the present window of FIG. 1A in a closed state;

FIG. 7B is an enlarged cross sectional view of the present window taken along line B—B of FIG. 7A;

FIG. 7C is an enlarged cross sectional view of the present window taken along line A—A of FIG. 7A;

THE DETAILS OF THE INVENTION

The structures of an upper sash assembly and upper horizontal frame section are respectively the same as that of a lower sash assembly and lower horizontal frame section. The lower sash assembly and lower horizontal frame section are set forth hereinafter by reference.

Figure 1A:
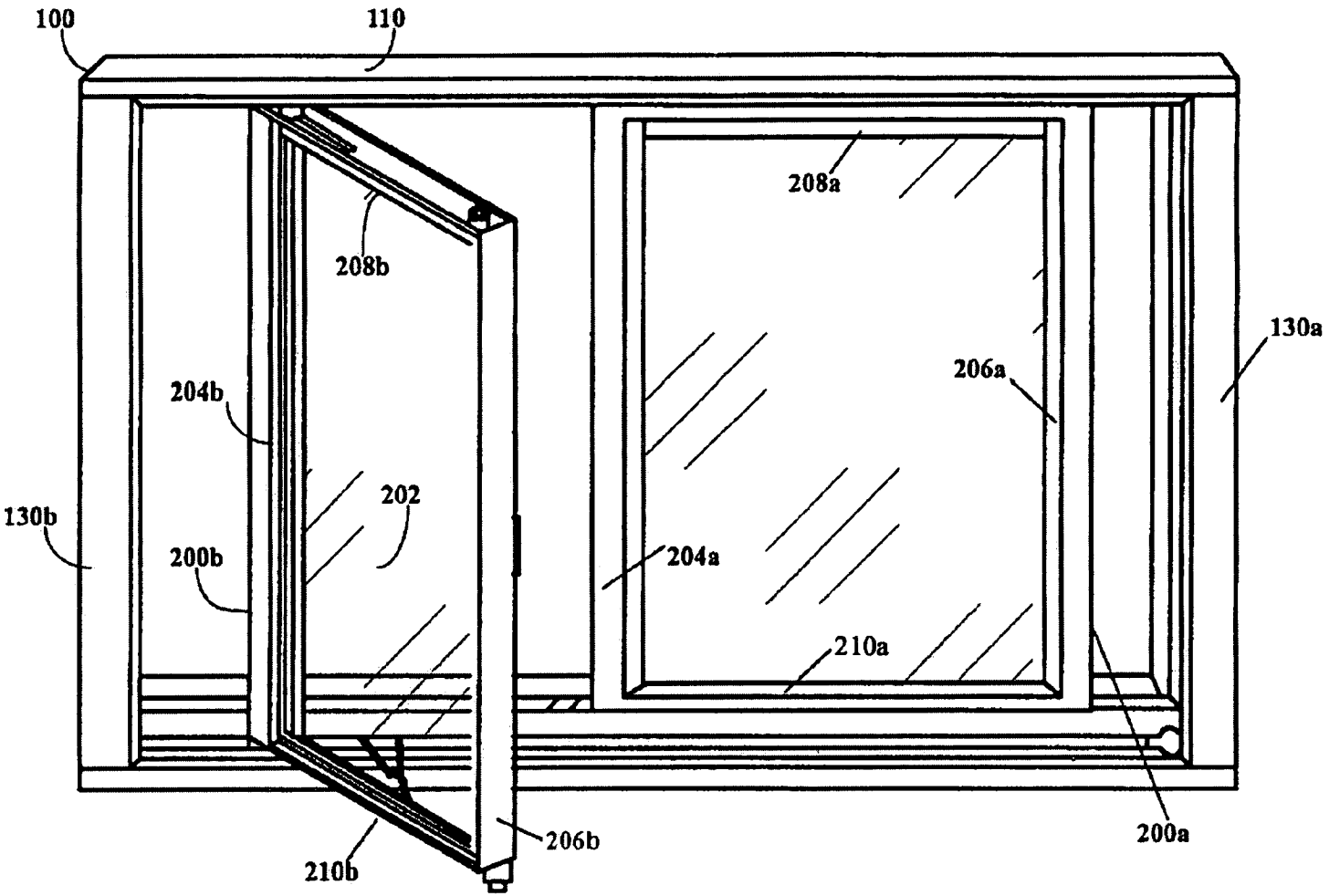
FIG. 1A is a perspective view of a window of the present invention, showing that the window of the invention can be pushed/pulled and opened outwards.

The present window has a double frame assembly 100, as shown in FIG. 1A, in which an outer sash assembly 200*b* is opened outwards, and an inner sash assembly 200*a* is opened by push/pull manner. The frame assembly 100 includes a pair of horizontal frame sections 110 and a pair of vertical frame sections 130, matching with the window opening of the structure (not shown). The sash assembly 200(*a, b*) for fastening glass medium includes a stile 204(*a, b*) for containing a hinge, a stile 206(*a, b*) for containing a locking pin assembly, an upper rail 208(*a, b*), and a lower rail 210(*a, b*). A plan schematic view of the sash assembly 200(*a, b*) in fully closed state is seen in FIG. 7A.

Figure 1B:
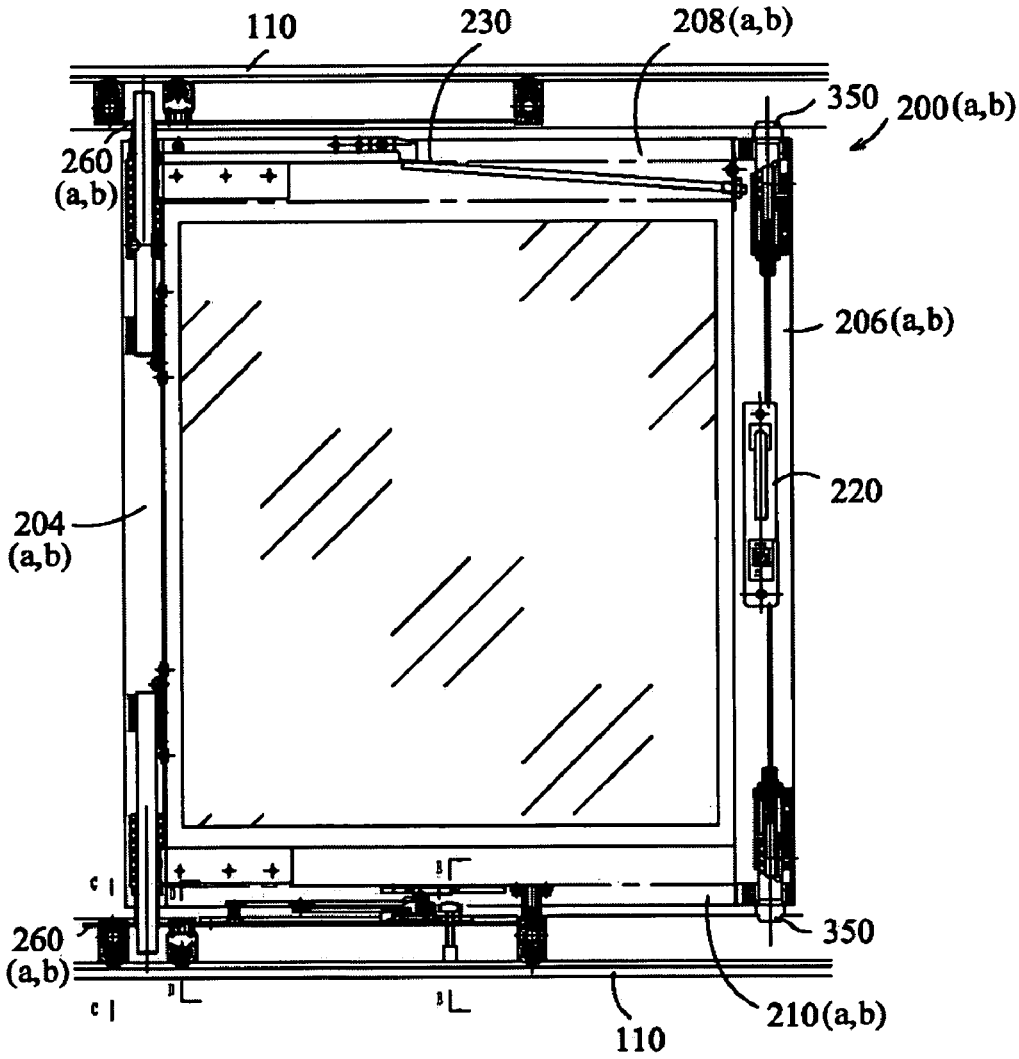
FIG. 1B is a longitudinal cross section view of the window shown in FIG. 1A.

Referring to FIG. 1B, a sliding pipe assembly 260(*a, b*) can slide along the horizontal frame section 110 and is installed on upper rails 208(*a, b*) and lower rails 210(*a, b*). In addition, a tension assembly 230(*a,b*) is provided inside the upper rail 208(*a, b*) for tightening the sash assembly 200(*a,b*) to enhance stability. Hence, four corners of each sash assembly 200(*a, b*) of the present invention are locked under a fully closed state.

Figure 2:
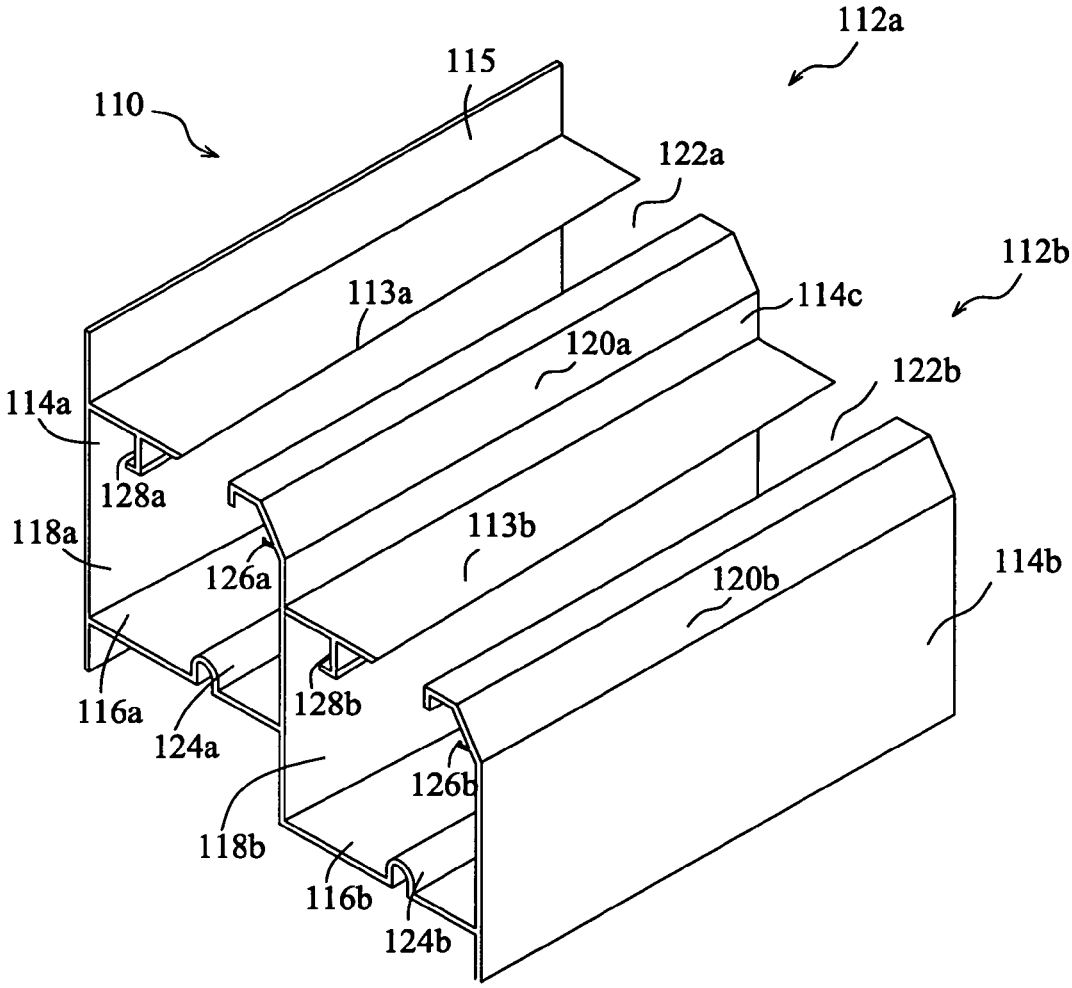
FIG. 2 is a perspective view of a partial horizontal frame section of the frame assembly of the present invention, showing that a guide track and a pair of subsidiary guide tracks is disposed in the cavity of each horizontal frame.

The horizontal frame section 110 is provided with two parallel-installed horizontal frames 112*a* and 112*b*. Referring to FIG. 2, the two parallel-installed frames 112*a* and 112*b* are staggered relative to each other, and the inner horizontal frame 112*a* is slightly higher than the outer horizontal frame 112*b*. The horizontal frames 112(*a, b*) have a cavity 118(*a, b*) and are primarily isolated by a common slab 114*c*, which includes a top slab 113(*a, b*), a side slab 114*a* or 114*b*, and a bottom slab 116(*a, b*). The top slab 113(*a, b*) is provided with an opening 122(*a, b*), and the bottom slab 116(*a, b*) is provided with a guide track 124(*a, b*). Particularly, a pair of subsidiary guide tracks 126(*a, b*) and 128(*a, b*) are mounted within the cavity 118(*a, b*); for example, it can be mounted to the side slabs 114(*a, b*) or top slab 113(*a, b*), respectively. In order to easily close the sash assembly 200, a slant slab 120(*a, b*) is formed between the top slab 113*a* and the common slab 114*c* or the top slab 113*b* and the outer side slab 114*b*. The oblique of the slant slab 120(*a, b*) is preferably 45 degrees. Moreover, the side slab 114*a* of inner horizontal frame 112*a* extends outwards to form a slab extension 115, used for matching with the strip (not shown).

Figure 3A:
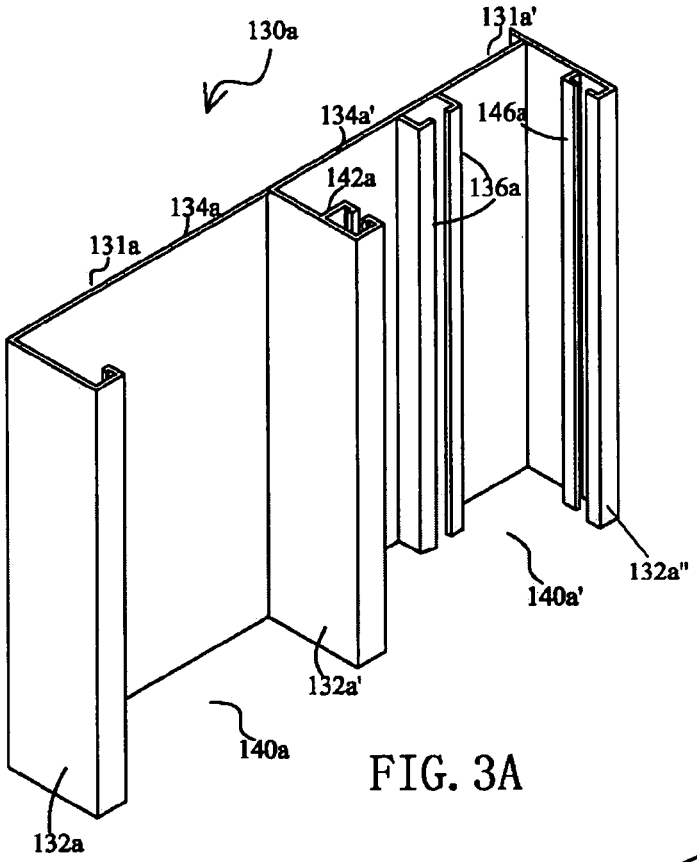
FIG. 3A is a perspective view of a partial left side vertical frame section of the present invention, in which a support for fastening top wool is provided on the side slab of an inner frame.

FIG. 3A shows a left side vertical frame section 130*a* which has two parallel-installed vertical frames 131*a* and 131*a*'. Initially, the vertical frames 131*a* and 131*a*' are isolated by an element 132*a*'. Each vertical frame 131*a* or 131*a*' has a cavity 140*a* and 140*a*', an element 132*a* or 132*a*", and a side slab 134*a* or 134*a*'. A pair of supports 136*a* on the side slab 134*a*' are separated at a pre-determined distance for mounting a plastic strip (not shown) to buffer the impaction force of the sash assembly 200*b* in a push and pull mode, as shown in FIG. 7C. Meanwhile, a pair of supports 142*a* and 146*a* are also separated at a pre-determined distance on the element 132*a*' and 132*a*" of the outer vertical frame 131*a*' for fastening the top wool to seal the window together with the sash assembly 200*b*.

Figure 3B:
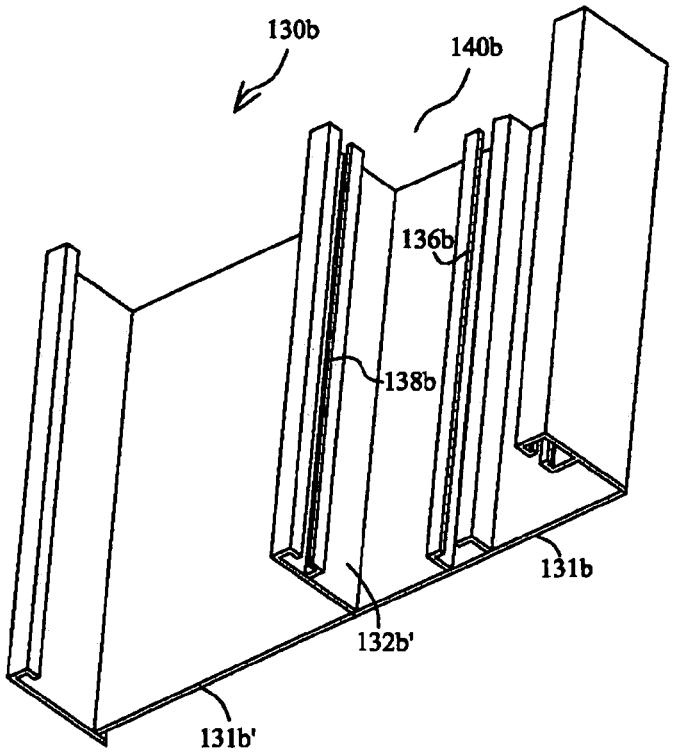
FIG. 3B is a perspective view of a partial right side vertical frame section of the present invention, in which a support for fastening the strip is provided on the side slab of an outer frame.

FIG. 3B shows a right side vertical frame section 130*b*, of which two vertical frames 131*b* and 131*b*' are isolated by an element 132*b*'. The difference is that support 136*b* for fastening a plastic strip (not shown) to buffer the impaction force and a pair of supports 138*b* for fastening top wool (not shown) to seal the window are provided in the inner vertical frame 131*b*.

Figure 4A:
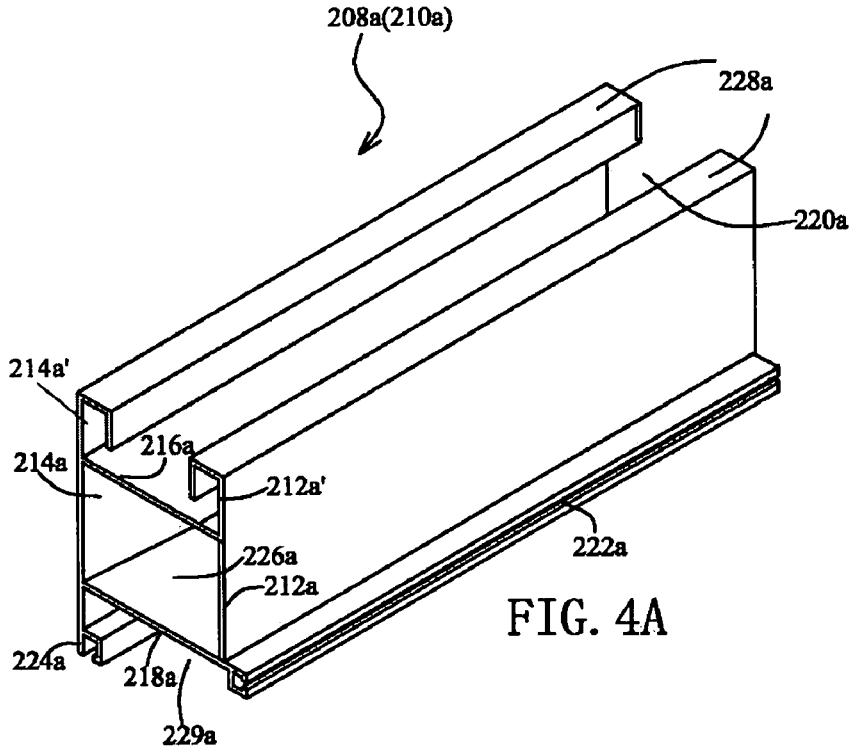
FIG. 4A is a perspective view of a partial rail matched with the inner frame of the present invention.

FIG. 4A is a perspective view of the rail 208*a* matched with the inner horizontal frame 112*a*, which includes an inner slab 212*a* and an outer slab 214*a*, wherein the separation between them should adapt with cavity 140*a*' of the vertical frame 130*a* (see FIG. 3A), and an upper slab 216*a* and a lower slab 218*a*, forming a chamber 226*a* together with the slabs 212*a* and 214*a*. The rail 208*a* also includes a pair of fasteners 228*a* for fastening glass 202 (see FIG. 1A), being formed by extension parts 212*a*' and 214*a*' which are extended upwards from the slabs 212*a* and 214*a* and form a spacing 220*a* by bending inwards. A pair of supports 224*a* are fastened on the extension part of the slab 214*a*, which extends downwards for mounting top wool (not shown) to match with the top slab 113*a* of the inner horizontal frame 112*a*, as shown in FIG. 7B. Another pair of supports 222*a* are fastened on the extension part of the slab 218*a*, which extends inwards for mounting top wool (not shown) to match with the slab extension 115 of horizontal frame 118, as shown in FIG. 7B. A space 229*a* is formed between two pair of the supports 222*a* and 224*a*.

Figure 4B:
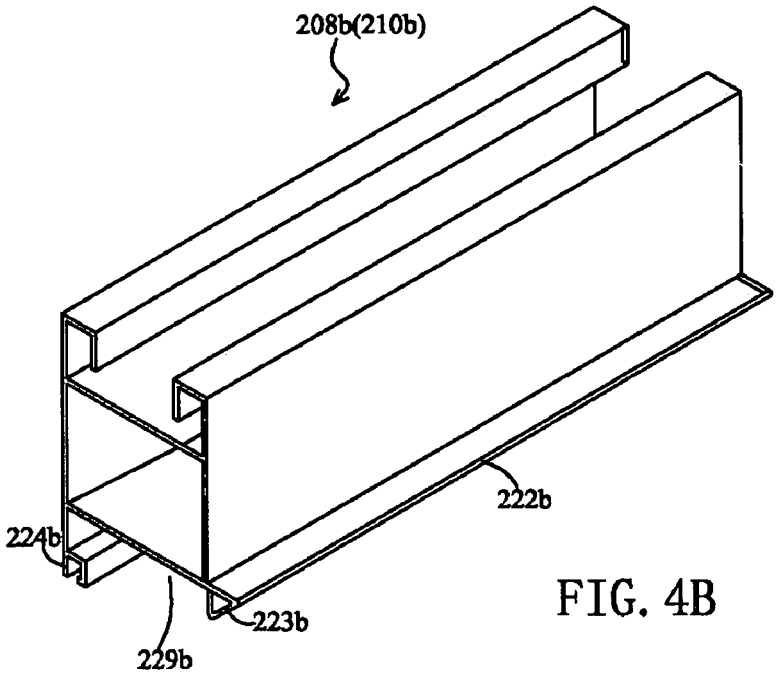
FIG. 4B is a perspective view of the partial rail matched with the outer frame of the present invention.

FIG. 4B is a perspective view of the rail 208*b* matched with the outer horizontal frame 112*b* of the present invention, wherein its structure is substantively the same as that of the rail 208*a*. The difference is that a pair of supports 222*b* on an extension part are formed to be triangular, and the top wool (not shown) on it matches with the slant slab 120*a*.

Figure 5:
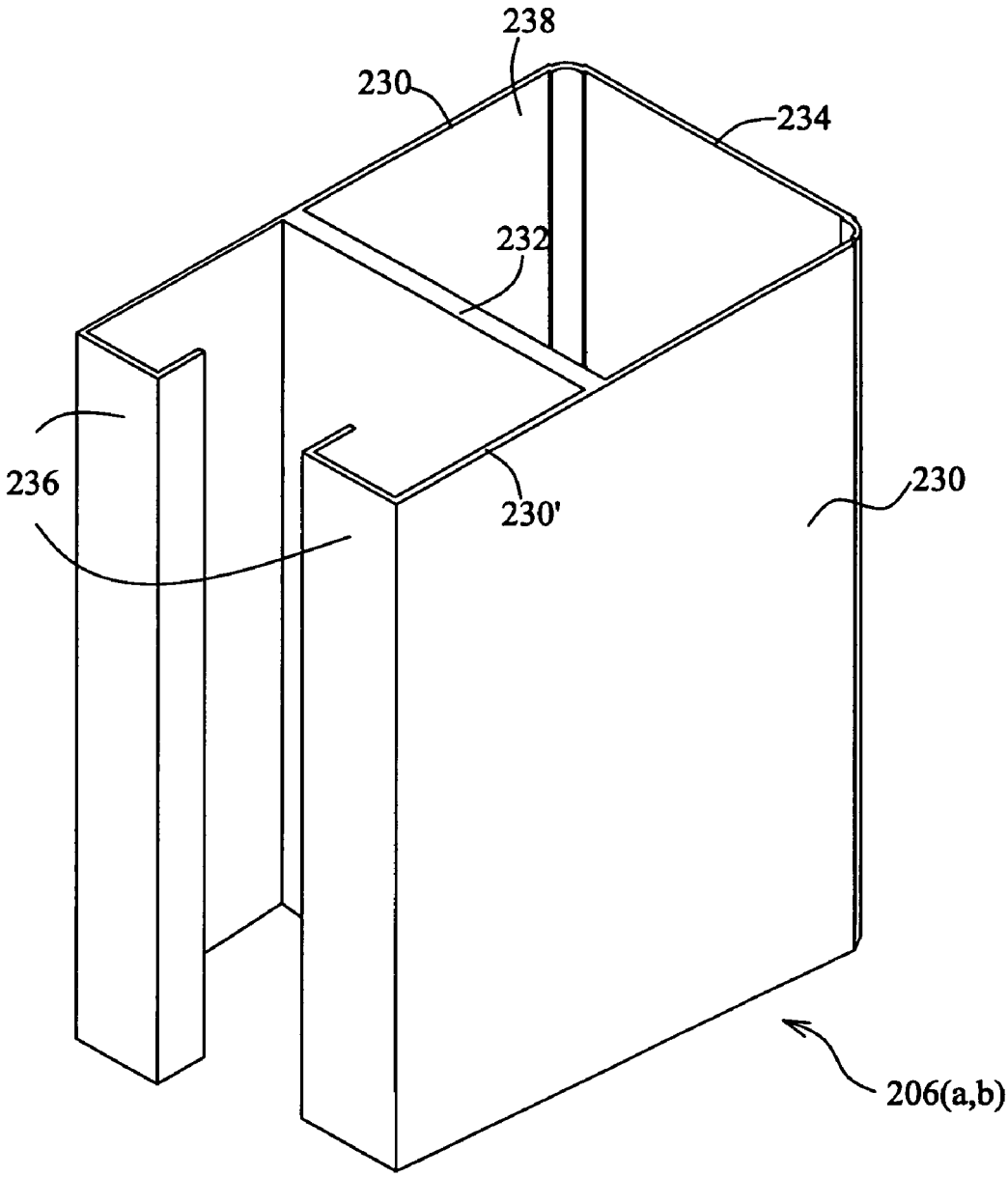
FIG. 5 is a perspective view of a partial stile for containing the locking pin assembly of the present invention.

The stile 206(*a, b*) for containing the locking pin assembly is integrated according to the present invention, as shown in FIG. 5. It comprises a pair of side slabs 230, which are simply separated to adapt the cavity 140(*a, b*) of the vertical frame 130(*a, b*) (see FIGS. 3A and 3B), a vertical slab 232, an end cover 234 forming a chamber 238 with a pair of side slabs 230 and the vertical slab 232, and a fastener 236, formed by an extension part 230' of the slab 230 bending inwards.

Figure 6A:
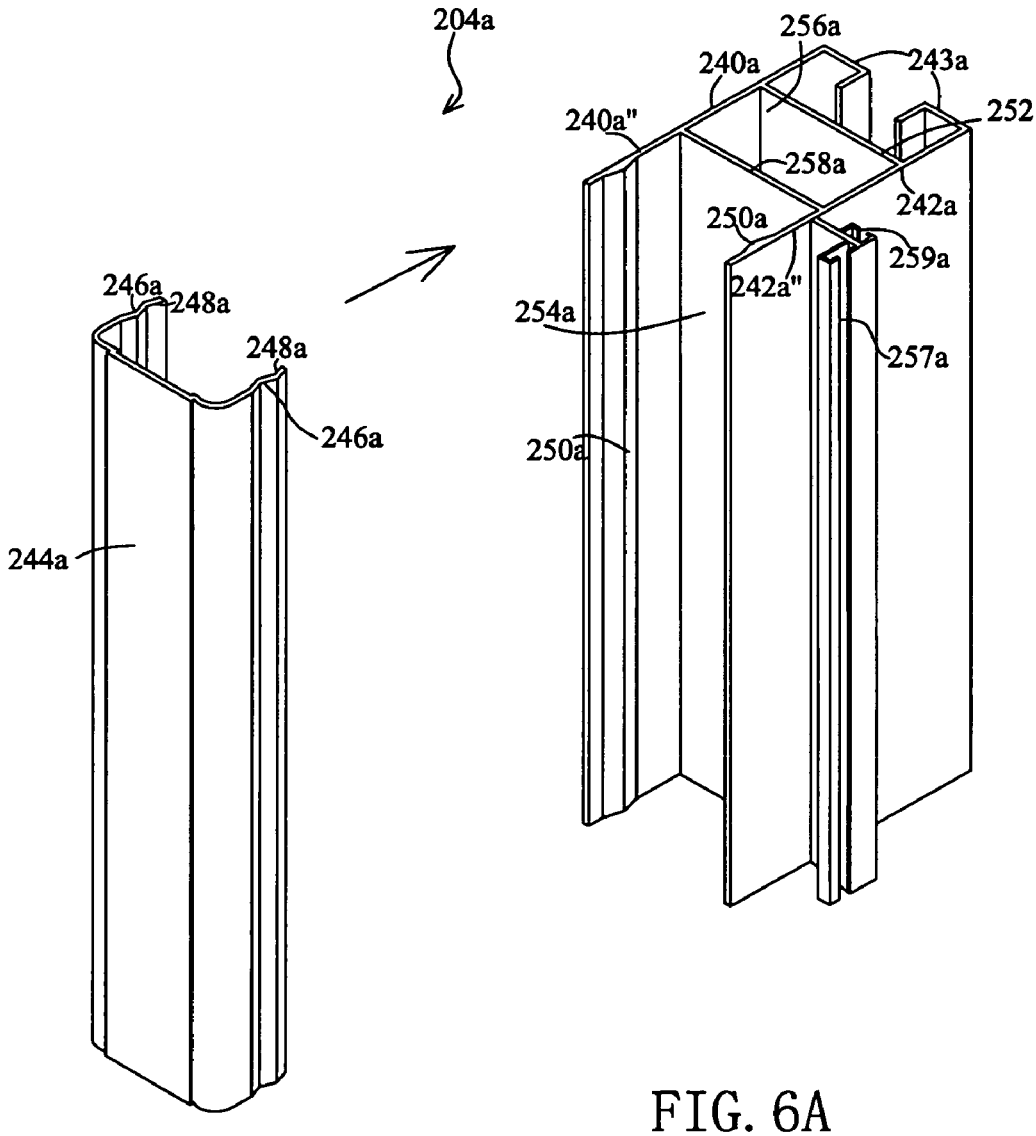
FIG. 6A is an exploded perspective view of the partial stile for containing the hinge assembly matched with the outer frame of the present invention, showing that the end cover and the main body are in movable connection.

An end cover and a main body of the stile for containing the hinge assembly are in movable connection in order to be convenient for mounting and maintaining operation. Referring to FIG. 6A, the stile 204*a* is matched with the inner vertical frame. Two extension parts 240*a*" and 242*a*" are respectively formed by the side slabs 240*a* and 242*a* extending outwards. An arris 250*a* is provided near the end of each extension part 240*a*" and 242*a*". The recess 246*a* is therefore formed near each end 248*a* of cover 244*a* to match with each arris 250*a*. Particularly, the end 248*a* should be bent slightly inwards in order to be convenient for connection. A fastener 243*a* is formed by extension parts of the side slabs 240*a* and 242*a* bending inwards for fastening glass medium 202. In addition, the vertical slab 252 divides the inside of the stile 204*a* into spaces 254*a* and 256*a*. Particularly, a lap joint 257*a* is provided on the side slab 242*a* of the stile 204*a* to seal the overlapped part between the inner and outer sash assembly by top wool. In addition, a fastening support 259*a* is also provided on the side of the lap joint 257*a* for fastening plastic strip.

Figure 6B:
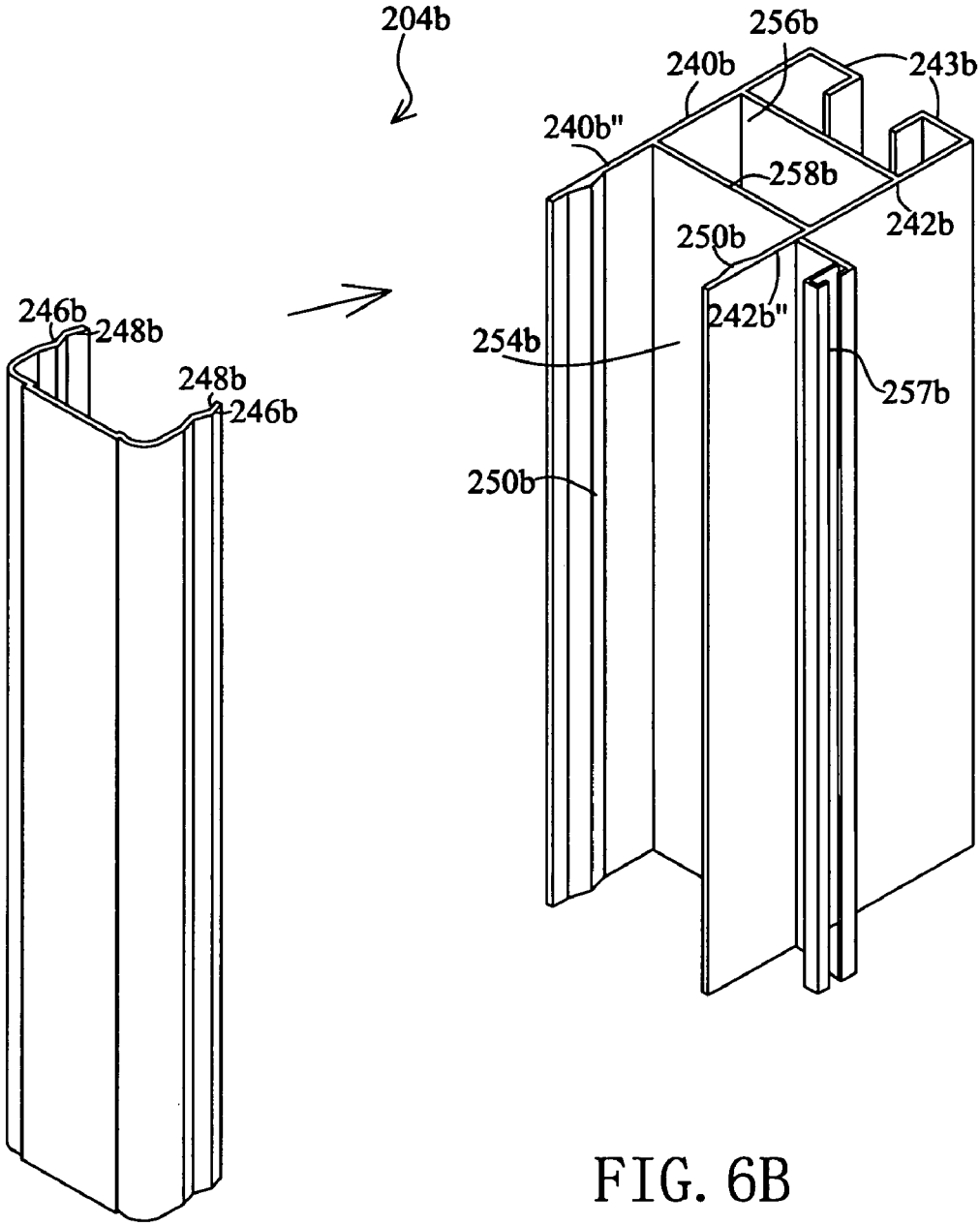
FIG. 6B is an exploded perspective view of the partial stile for containing the hinge assembly matched with the inner frame of the present invention.

The difference between the stile 204*b* matched with the outer vertical frame and the above stile 204*a* is that only a lap joint 257*b* is provided on the side of the stile 204*b*, as shown in FIG. 6B. Thus, when two sash assemblies are pulled/pushed to close, fastening support 259*a* with plastic strip on the inner sash assembly as shown in FIG. 6A can buffer the impact from the lap joint 257*b*, and can seal the overlapped part.

Figure 8A:
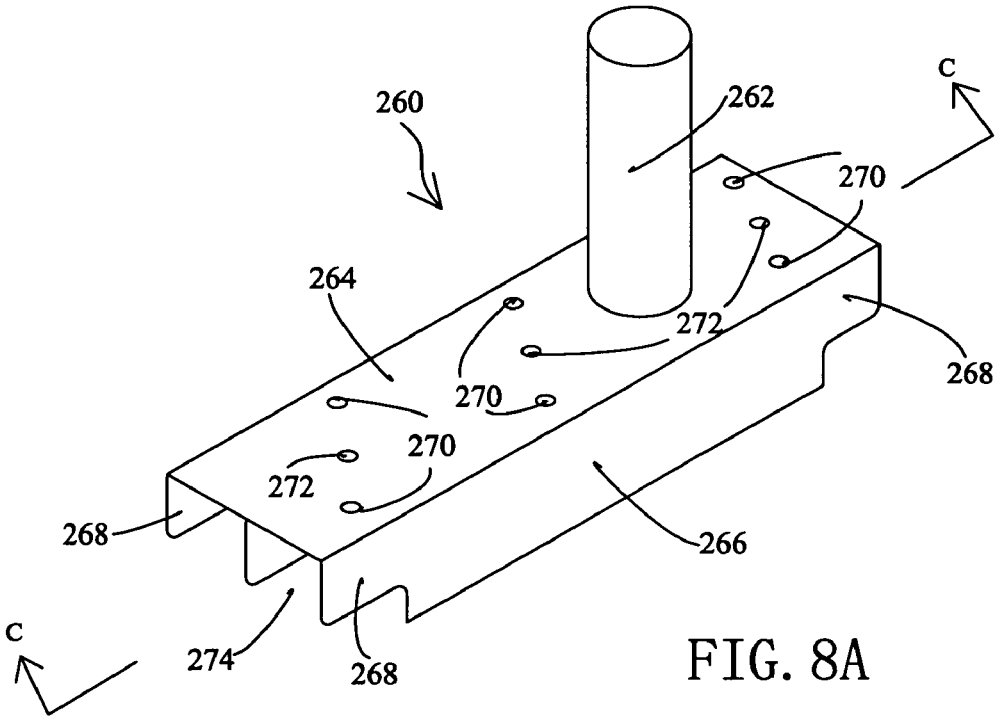
FIG. 8A is a perspective view of the sliding pipe of the present invention, showing that the hinge is fastened on the sliding pipe.
Figure 8B:
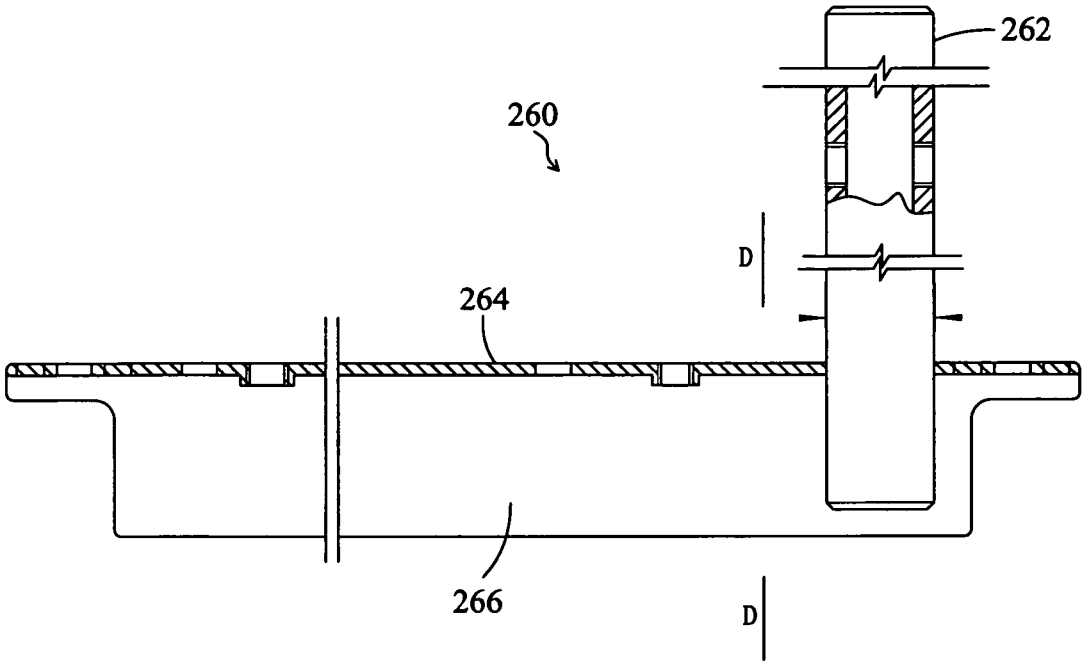
FIG. 8B is cross sectional view of the sliding pipe taken along line C—C of FIG. 8A.
Figure 8C:
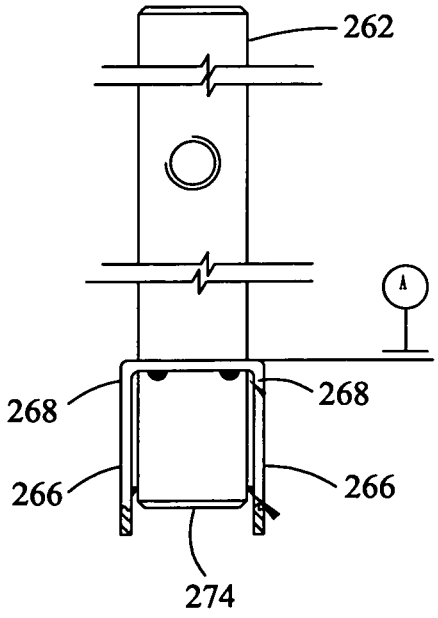
FIG. 8C is a cross sectional view of the sliding pipe taken along line D—D of FIG. 8B.

FIG. 8A shows a perspective of a sliding pipe assembly 260 with the adjustable roller being removed. The sliding pipe assembly 260 includes a sliding pipe 264 having a pair of side walls 266 with sunken ends 268, on which several mounting holes 270 and regulating holes 272 for fastening the roller supports (not shown) are provided. A hinge 262 is mounted on the top of sliding pipe 264, and a space 274 is used for mounting the adjustable rollers of the present invention. It can be seen from FIGS. 8B and 8C that the hinge 262 penetrates the sliding pipe 264, and is in rigid connection with the pipe.

Figure 9B:
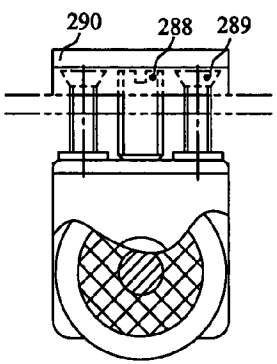
FIG. 9B is a partial cross sectional view of the adjustable roller of FIG. 9A, showing the side of roller.
Figure 9C:
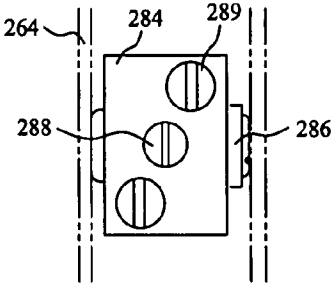
FIG. 9C is a top view of the adjustable roller of FIG. 9B.
Figure 9A:
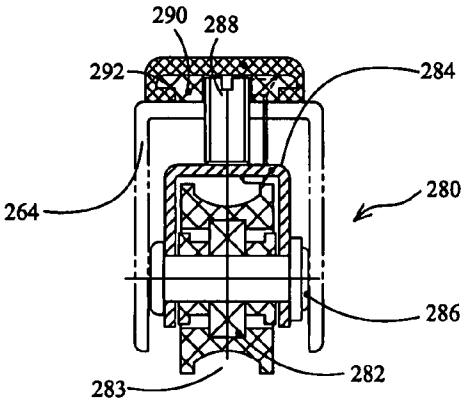
FIG. 9A is a schematic view of assemblage of an adjustable roller and the sliding pipe.
Figure 9D:
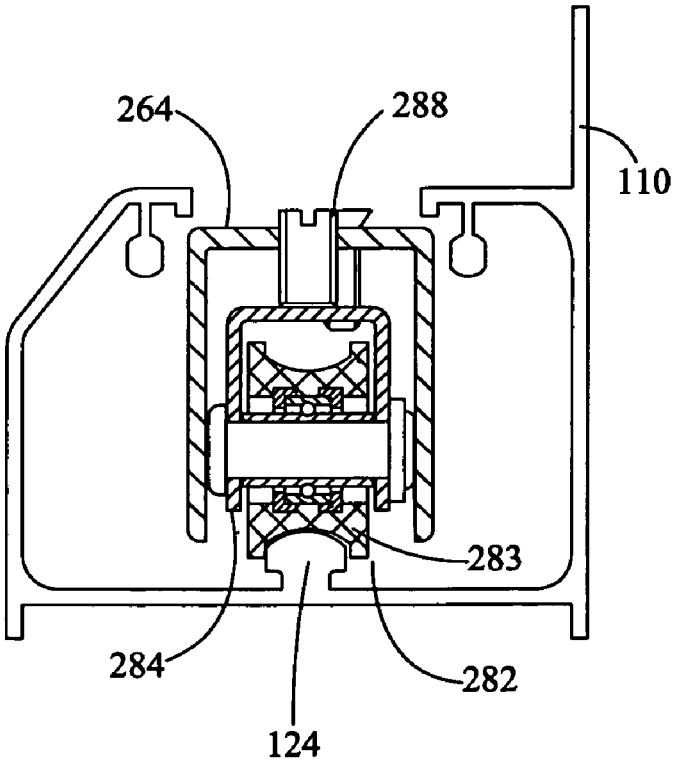
FIG. 9D is an assembled schematic view of the adjustable roller of FIG. 9A and the sliding pipe and horizontal frame of the present invention.

It is understood that plenty of sliding means can be applied in the present sliding pipe assembly to realize the movement along the guide track on the horizontal frame. The schematic view of the preferred embodiment of the sliding means is shown in FIGS. 9A–9C. A roller device 280 is installed in space 274 of sliding pipe 264, and includes a roller support 284 having a bottom with an opening, a top fastened with the sliding pipe 264 via a location hole, and two side sections each having an aligned location hole. The roller device 280 also includes a roller 282, of which a pivot 286 is fastened to the aligned location holes of both side sections for matching with the guide track 124, and a regulator 288 for regulation of matching between the roller and the guide track, penetrating through the sliding pipe 264 and pressing on the top of the roller support 284. Preferably, a sliding slot 283 should be provided on the roller 282. Meanwhile, a pad 290 is also provided on the sliding pipe 264 to support the middle of the sash assembly. The pad 290 has several holes, which can be penetrated by the location elements 289 and regulator 288, and a shoulder 292. From a schematic view of position relationship between the adjustable roller device 280, sliding pipe 264 and horizontal frame 110 as shown in FIG. 9D, the height of roller support 284 may be regulated via regulator 288, and therefore roller 282 can match well with the guide track 124.

Figure 10B:
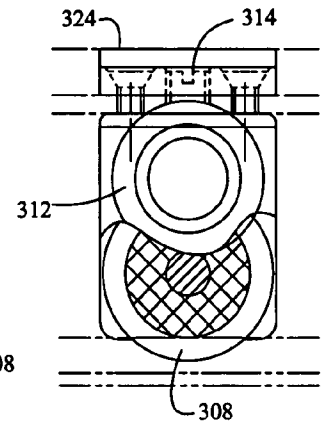
FIG. 10B is a partial cross sectional view of the tri-axial adjustable roller and sliding pipe of the present invention.
Figure 10C:
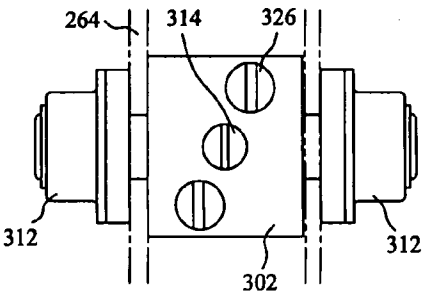
FIG. 10C is a top view of the adjustable roller of FIG. 10B.
Figure 10A:
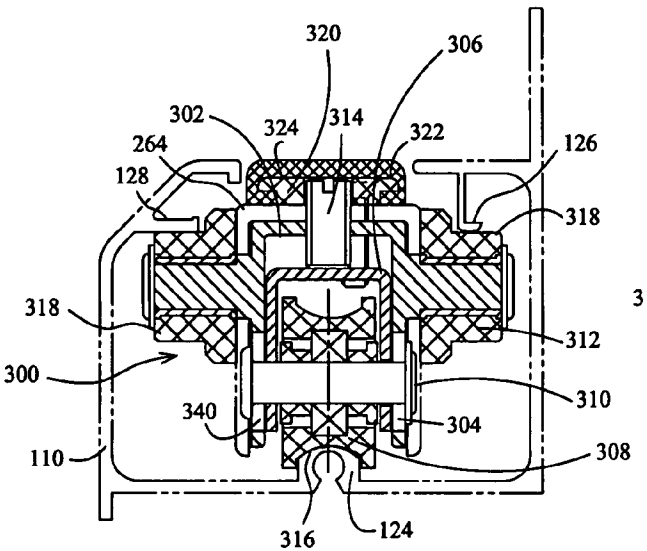
FIG. 10A is an assembled schematic view of the tri-axial adjustable roller and the horizontal frame and sliding pipe of the present invention.

More particularly, a pair of tri-axial roller devices 300 are provided on both ends of the sliding pipe 264 in accordance with the present invention, to improve the stability of sliding pipe assembly 260. As shown in FIGS. 100A–10C, the pair of tri-axial roller devices 300 are also provided in space 274. Firstly, a roller seat 302 is provided thereof and is fastened to the sliding pipe 264 by the location holes at a top of the roller seat, which has a bottom with an opening and two aligned sliding slots 304 on two side sections. A roller support 306 is then mounted in the roller seat 302 and is also fastened to the sliding pipe 264 by the location holes at the top of the roller seat, which has a bottom with an opening and a pair of mounting holes on two side sections. The mounting holes are aligned with the sliding slots 304, respectively. A main roller 308 to be matched with the guide track 124 of FIG. 2 can then be fastened with the mounting hole by its pivot 310. Obviously, the pivot 310 can also be movable along the sliding slots 304 when the roller support 306 is regulated. The tri-axial roller device 300 also includes two subsidiary rollers 312 configured for matching with the pair of subsidiary guide tracks 126 and 128 provided in horizontal frame 110 of FIG. 2. The subsidiary rollers 312 are symmetrically mounted outside two side sections of the roller seat 302. Preferably to minimize the mounting size, the symmetrical central line of a pair of subsidiary rollers 312 should coincide with the central line of the main roller 308, as shown in FIG. 10B, and the sunken ends 268 of sliding pipe 264 of FIG. 8A should exactly be provided the space between the subsidiary roller 312 and roller 308. A regulator 314 is applied in the tri-axial roller device 300, which is used for adjusting the vertical separation between the main roller 308 and the subsidiary rollers 312 so as to be closely matched with the guide tracks. For example, when the regulator 314 is adjusted downwards, the roller support 306 together with the main roller 308 will move downwards and the vertical separation between the subsidiary roller 312 and the main roller 308 will be accordingly increased. Thus, the rollers can be in close contact with the guide tracks to ensure that the sliding pipe assembly 260 of the present invention can slide stably in horizontal frame 110.

Obviously, the main roller 308 and the subsidiary roller 312 should have sliding slots 316 and 318 to maximize the surface for matching with the guide tracks.

Similarly, at the fulcrum of the window, another pad 320 is provided on the sliding pipe 264 and includes several holes penetrated by the location elements 326 and regulator 314, and a shoulder 322. In addition, a cover plate 324 may be provided on sliding pipe 264, wherein its hook and the shoulder 322 of pad 320 are fastened.

Figure 11:
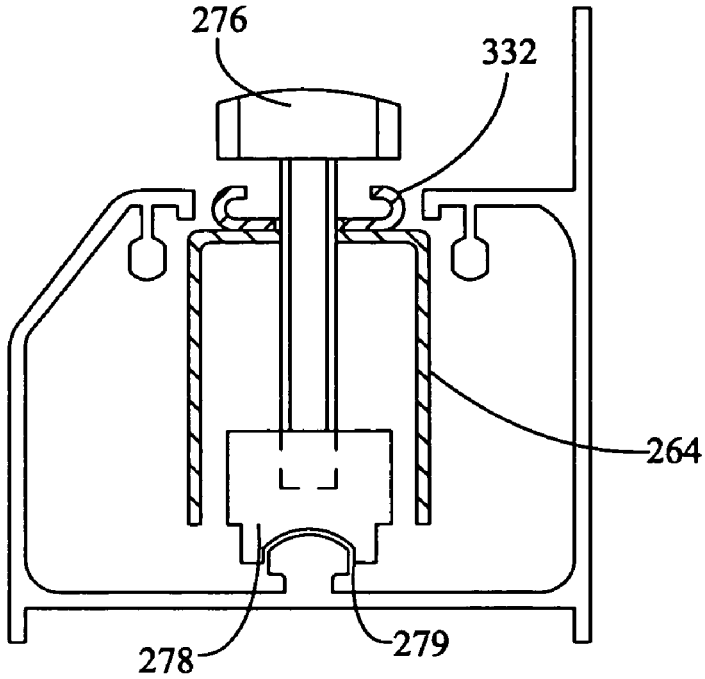
FIG. 11 shows a location device of the sliding pipe assembly of the present invention.

Moreover, because it is necessary to consider the demand of the location for the sliding pipe assembly 260, a location device is disposed thereon. Referring to FIG. 11, a bolt 276 penetrates a hole on the top of sliding pipe 264. A pressed-block 278 is provided at the end of the bolt 276, on which a recess 279 is provided to be used for matching with the guide track 124 of FIG. 2. In this way, the sliding pipe 264 will be in a removable/immovable state when loosening/locking the bolt 276.

Figure 12B:
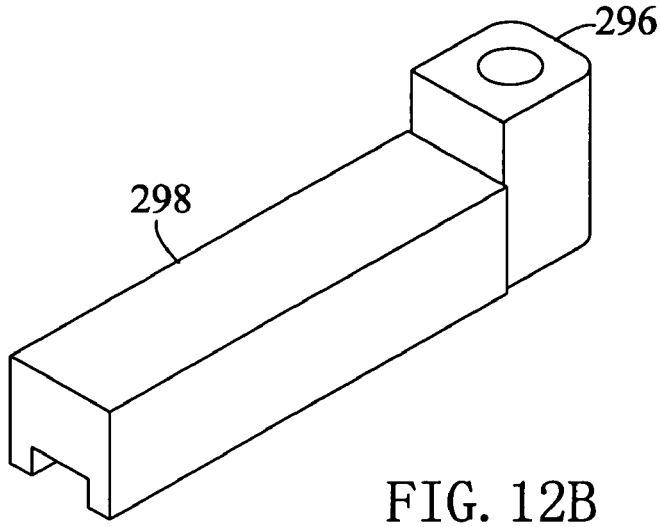
FIG. 12B is a perspective view of the hinge sleeve of FIG. 12A.
Figure 12A:
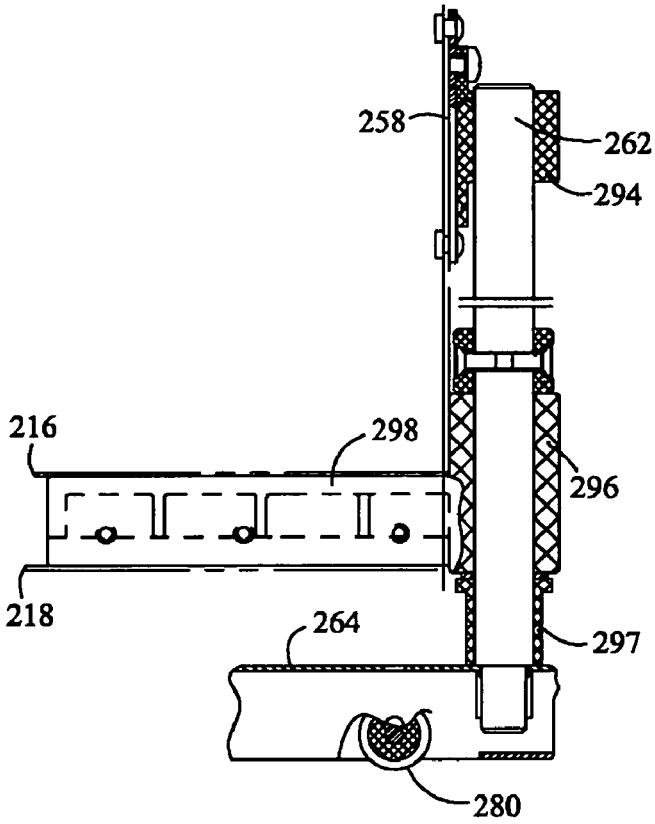
FIG. 12A is an assembled schematic view of the sliding pipe assembly and the sash assembly of the present invention.

FIG. 12A illustrates the hinge assembly being mounted within the stile 204. The hinge 262 is provided in space 254 of FIG. 6A by a hinge sleeve 296, as shown in FIG. 12B, and can rotate in relation to the hinge sleeve 296. In fact, the present invention integrates the rail 208/210 and the stile 204 of the sash assembly 200 with the hinge sleeve 296. Firstly, the sleeve 296 is also provided in the stile 204, and the top of hinge 262 is fastened to the interior of the stile 204, such as a slab 258, by a sleeving 294 after inserting the hinge sleeve 296. A rod 298 is integrated with the sleeve 296 and is provided in the rail 208/210 in order to make the sash assembly 200 rotate around the hinge 262. Certainly, considering the requirement of mounting, axial bush 297 should be provided between the sliding pipe 264 and the hinge sleeve 296, which may also be used for supporting the hinge sleeve. Therefore, it is understood that the end cover 244 in movable connection with the body of the stile 204 is convenient for mounting of the hinge assembly. On the other hand, it is also convenient for maintaining operation; that is, the sash assembly 200 can be unloaded easily after removing the end cover 244 when the glass is damaged in an accident.

Figure 13C:
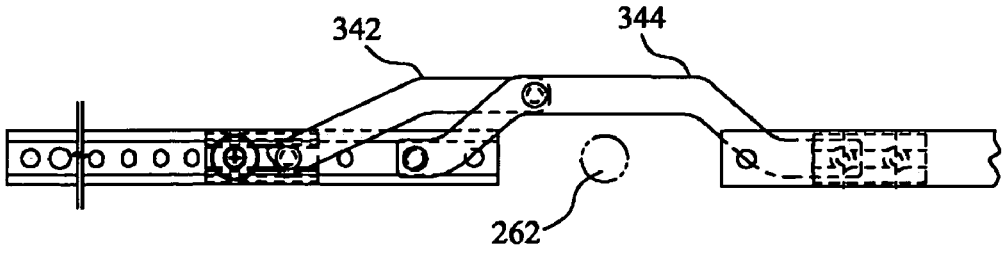
FIG. 13C is a schematic view of the rotary arm assembly of the present invention, in which two slideways are fully opened to be at an angle of 180 degrees.
Figure 13A:
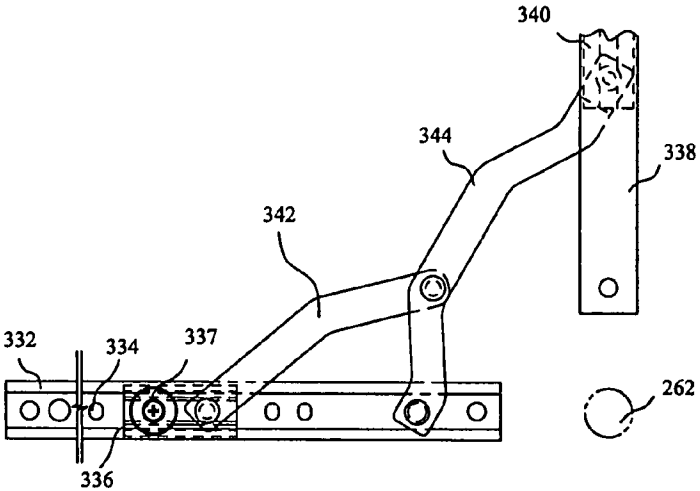
FIG. 13A is a schematic view of the rotary arm assembly of the present invention, in which two slideways are in perpendicular positions.
Figure 13B:
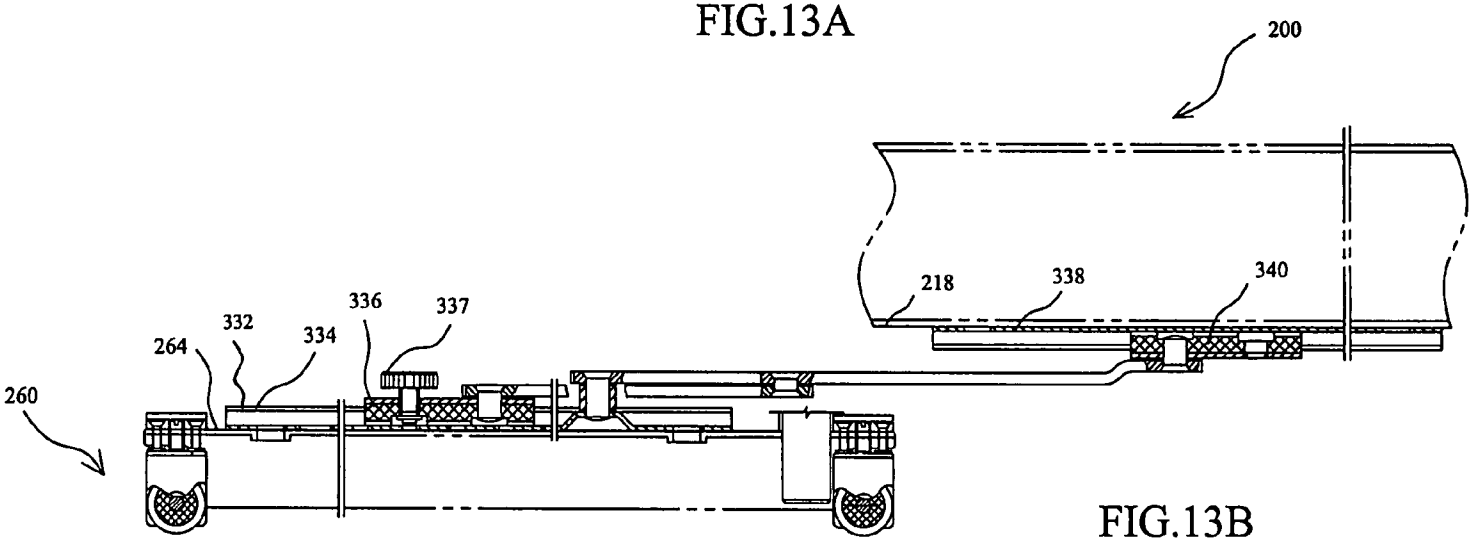
FIG. 13B is a partial cross sectional view of the rotary arm element along line E—E of FIG. 13A.

The rotary arm assembly 330 of the present invention can not only be used to fasten the sash assembly 200 when it opens outwards, but can also be used to support the sash assembly when it rotates to 180 degrees. FIGS. 13A–13B show a state in which the window is opened to 90 degrees. A first slideway 332 is fastened on the top of sliding pipe 264 (see FIG. 13B) via location holes on a bottom 334 of the first slideway and is provided with a first slide block 336. A second slideway 338 is provided with a second slide block 340. There is a stand bar 344 having two ends and a pivoted arm 342 having two ends. Both ends of the stand bar 344 are hinged with the first slideway 332 and the second slide block 340 in the second slideway 338, respectively. Both ends of the pivoted arm 342 are hinged at a pre-determined position on the stand bar 344 and the first slide block 336 in the first slideway 332, respectively. The rotary arm assembly 330 is then locked by a sliding block knob 337, provided on the first slideway 332, by stopping the first slide block 336.

Since the hinge 262 is provided in the stile 204, the stand bar 344 needs a special design in order to avoid the stop of the hinge. According to the present invention, a curvilinear swell extending outward needs to be provided at a predetermined position, and the pivoted arm 342 needs to be bent, preferably at an obtuse angle. In this way, the curvilinear swell part of the stand bar 344 can go around the hinge 262 and the end of the pivoted arm 342 hinged with the first slide block 336, as shown in FIG. 13C. Thus, the rotary arm assembly of the present invention ensures that the sash assembly can be opened to 180 degrees.

Figure 14B:
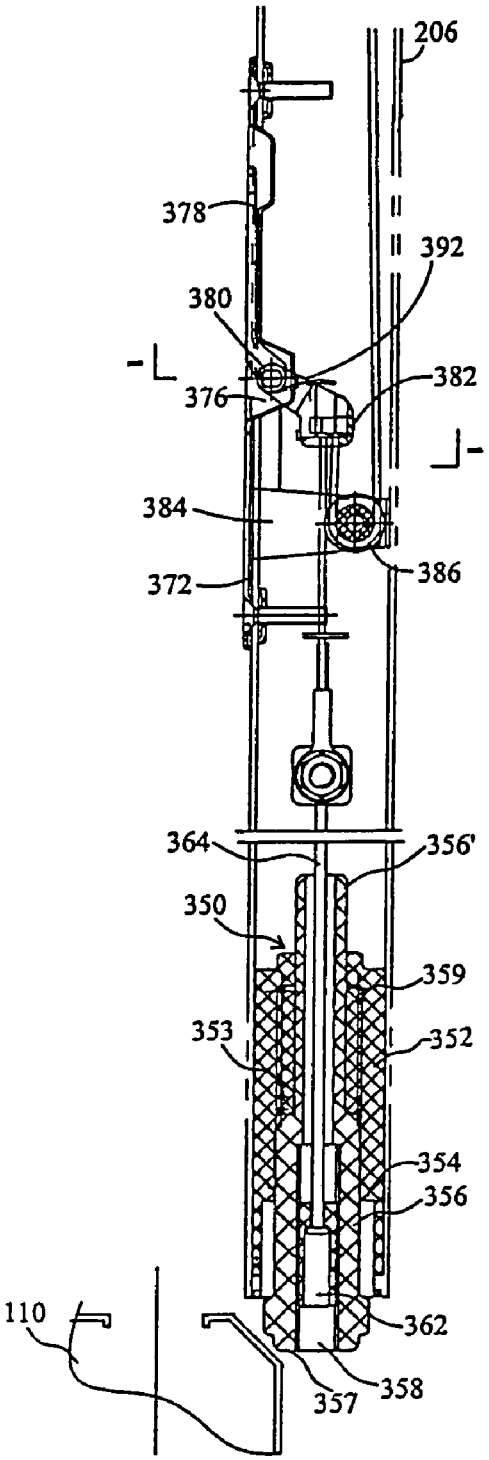
FIG. 14B is an assembled schematic view of the handle means of FIG. 14A and the locking pin assembly, showing that the sash assembly is in an open state.
Figure 14A:
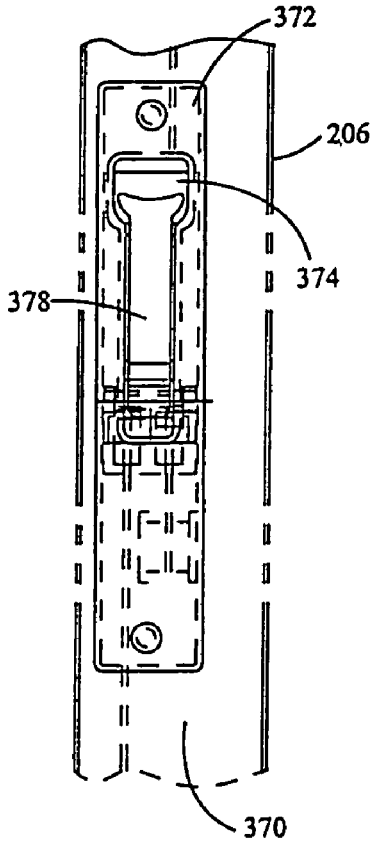
FIG. 14A is a front view of the handle means for locking of the present invention.
Figure 14C:
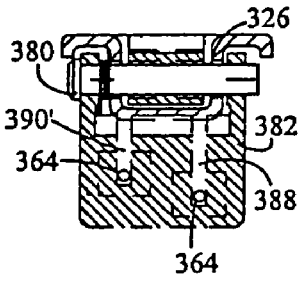
FIG. 14C is a cross sectional view of the handle means taken along line F—F of FIG. 14B.

FIGS. 14A–14B illustrate a handle means for locking and a locking pin assembly. The present locking pin assembly 350 (see FIG. 14B) is provided at upper and lower ends of the stile. The locking pin assembly 350 arranged in the lower end of the stile is set forth by reference hereinafter. The present locking pin assembly 350 matched with the horizontal frame 110 includes a base frame 352, a pin element 356, a spring 359 and a movable block 362. The base frame 352 has a keyway 353 and a base 354 formed at an inner part of the keyway 353. The pin element 356 has a body for adapting with the base 354, of which an outer end is formed as a protrusion 357 to be matched with an outer part of the keyway 353 and a body extension 356', penetrating through a central hole on the top of the base frame 352. The spring 359 is provided at the interior of the keyway 353 and pressed on the protrusion 357 of the pin element 356 for resetting the pin element. The movable block 362 can slide along a cavity 358 of the pin element 356 and is pulled by a bracing wire 364 (see FIG. 14B) connected to a handle, such as steer wire. When rotating the handle, the movable block 362 acts on the top of the pin element 356 to move the pin element upwards. Thus, the sash assembly 200 can be smoothly reset to the horizontal frame 110. When loosening the handle, the pin element 356 resets under the action of spring 359. Another advantage of the locking pin assembly 350 of the present invention is that the protrusion 357 of the pin element 356 shall impact to the slant slab 120 of the horizontal frame 110 once it experiences a strong wind. The spring 359 is then compressed by external force and finally locks the sash assembly after the sash assembly resets into the horizontal frame 110. Furthermore, the pin element 356 of the present invention can be not only used to lock the window, but can also act as a guide action in push and pull operations.

The handle means for locking 370 comprises a platen 372, a rotary handle 378, a rotary bracket 382 and a roller means 386. The platen 372 is arranged at a predefined position on the outer surface of the stile 206. Meanwhile, a recess 374 is formed at a front of the platen 372, and a supporting seat 376 is arranged at an end of the recess. The rotary handle for locking 378 is substantively adapted with the recess 374 and fastened to the supporting seat 376 by its axle 380. The rotary bracket 382 has two cavities 388 and 390, each of which has an opening. The rotary bracket 382 is provided at the back of platen 372 and fastened to the ends of the axle 380 outside the supporting seat 376. The rotary bracket 382 can be driven by the handle 378 through the axle 380. Preferably, the axle 380 is a flat axle. The roller 386 is mounted on the back of platen 372 via a support 384 and positioned below the rotary bracket 382.

One of bracing wires 364, which is connected to the moving block 362 in the lower locking pin assembly, is arranged in the cavity 388, and the other, which is connected to the moving block 362 in the upper locking pin assembly, is arranged in the cavity 390. Obviously, the guide slot for arranging the bracing wire is aligned with the opening of the cavity 390. In addition, a torsion-bar spring 392 is provided to depend on the rotary bracket 382 for resetting the handle.

Figure 15A:
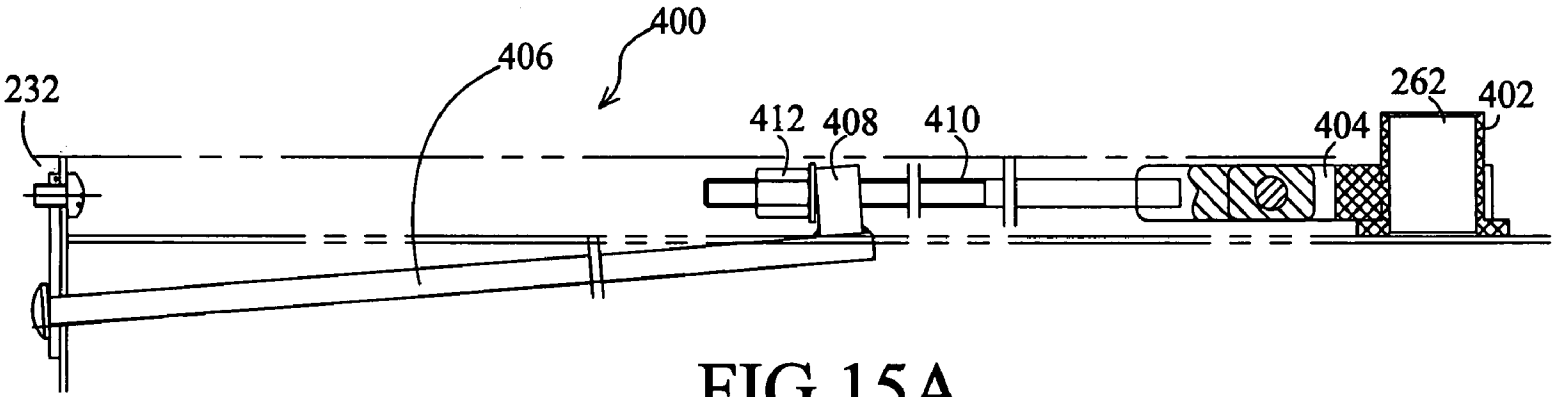
FIG. 15A is a longitudinal cross sectional view of a tension assembly of the present invention.
Figure 15B:
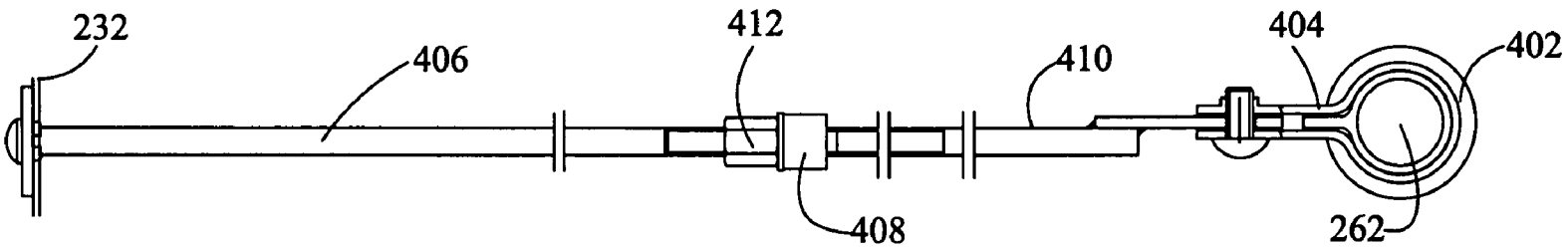
FIG. 15B is a top view of the tension assembly of FIG. 15A.

In general, the sash assembly with a glass medium is relatively heavy. Therefore, if the present sash assembly 200 is simply maintained by the upper and lower hinge assembly 260, the frame assembly will easily deform after being used for a certain time, rendering it ineffective for long time use as required. Therefore, a tension assembly needs to be arranged for improving the rigidity of the frame assembly 100, as shown in FIGS. 15A–15B. The present tension assembly 400 is provided in the upper rails. An axial bush 402 is located above the hinge sleeve 296 and is also inserted around the hinge 262. A pipe hoop 404 having two ends is fastened to the axial bush 402 through one of its ends. A tension brace 406 is fastened to the vertical slab 232 of the stile for containing the locking pin assembly and is provided with a ring 408 on the end. Meanwhile, a connecting piece 410 is fastened to the other end of the pipe hoop 404 and passes through the ring of the tension brace 406. Next, a fastening 412 is provided on the end of the connecting piece 410 for tightening the tension brace 406. In this way, the sash assembly will be kept in good working order whenever the sash assembly 200 of the present invention is in pull/push operation or opened outwards, due to stability improvement.

Figure 17:
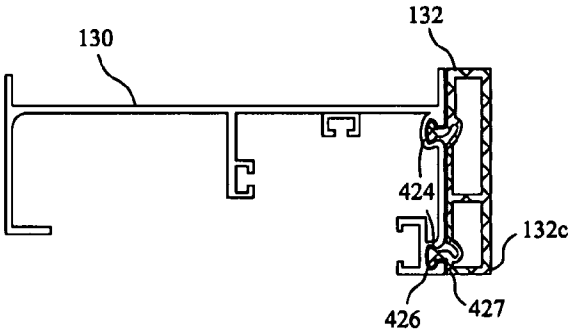
FIG. 17 is another preferred embodiment of the vertical frame of the present invention, in which the decorative frame made of plastics sectional material is coupled with the inside slab of the vertical frame by rolling technology.
Figure 16:
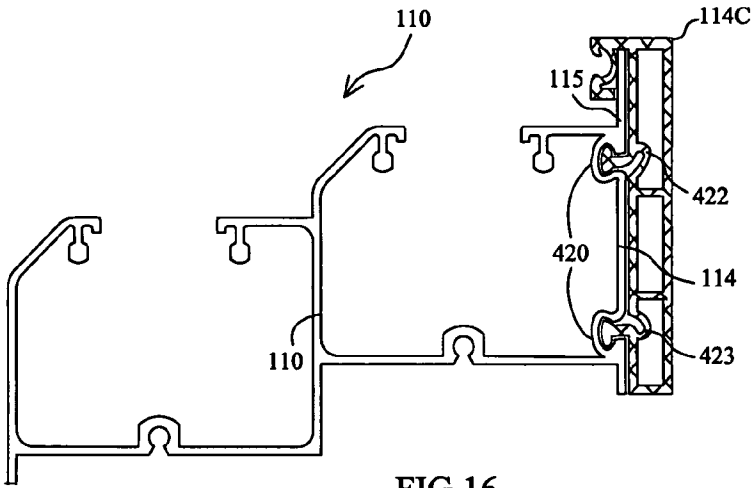
FIG. 16 shows another preferred embodiment of the horizontal frame of the present invention, in which a decorative frame made of plastics sectional material is coupled with the inside slab of the horizontal frame by rolling technology.

With respect to the present sash assembly and frame assembly, it is contemplated to have engineering plastics such as PVC material coupled to the inside of the sash assembly and frame assembly, both made of metal material, so that the heat-insulating property of the present window can be improved. It is known that sound insulation value for the engineering plastics is also significant. Therefore the above advantage of the present sash and frame assembly coupled with the engineering plastic is obvious for application in the north areas. FIGS. 16–17 respectively show the coupled horizontal and vertical frame sections of the present invention. Initially, a slot 420 is evenly arranged along the length of inner side slabs 114*a* and 115*a* of horizontal frame 112*a*. Next, a bending projection 422 integrated with the plastic sectional material is closely coupled with the slot 420 through rolling technology. Similarly, a slot 424 is also provided on the inner side 132 of the coupled vertical frame and is coupled with a bending projection 426 integrated with the plastic sectional material through rolling technology.

Figure 19:
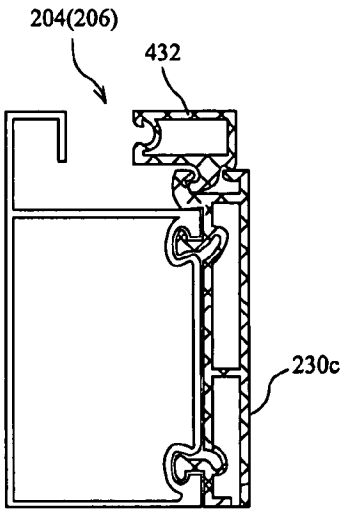
FIG. 19 is another preferred embodiment of the stile of the present invention, in which the decoration part is coupled with the inside slab of the stile by rolling technology.
Figure 18:
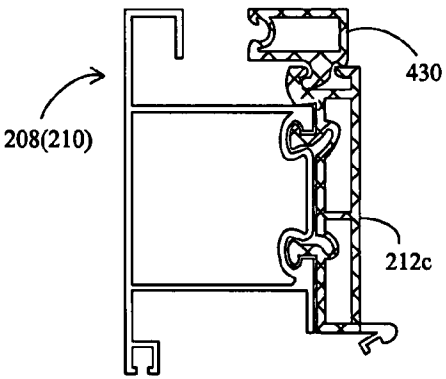
FIG. 18 is another preferred embodiment of the rail of the present invention, in which the decoration part is coupled with the inside slab of the rail by rolling technology.

FIGS. 18–19 are respectively cross section views of the coupled rail and stile. The coupled structure of the rail and stile is substantively the same as that of the frame section, and its structure is no longer described. However, the only difference is that a pressure element 430 and 432 is in lock joint with the plastic sectional material coupled with the rail/stile for compacting glass medium.

While the specific embodiments have been illustrated and described, numerous modifications come to mind without significantly departing from the spirit of the invention and the scope of protection is only limited by the scope of the accompanying claims.

What is claimed is:

1. A window that can be opened in multiple manners, comprising:

a frame assembly configured for fastening in a window opening, and including:

a pair of parallel horizontal frame sections, spaced apart from each other by a distance, each having a predefined length; and a pair of parallel vertical frame sections each having a predefined length and disposed between the pair of horizontal frame sections to form an enclosed frame;

at least two sash assemblies each configured for receiving a glass medium and disposed within the frame assembly to facilitate closing and opening of the window, each said sash assembly having:

a pair of rails for matching with the pair of horizontal frame sections, and at least two stiles for matching with said pair of vertical frame sections, and arranged to be perpendicular to the rails to form an enclosed sash;

wherein each said horizontal frame section includes two parallel horizontal frame portions, each of which includes a cavity with a top opening, a guide track provided on a bottom slab of the horizontal frame portion, and a pair of subsidiary guide tracks each located on a respective side of the guide track and mounted onto one of a slant slab and a top of the horizontal frame portion;

each said sash assembly includes a pair of sliding pipe assemblies, each said sliding pipe assembly including a sliding pipe configured for sliding in a respective one of the cavities;

each said sliding pipe includes:

a roller seat fastened to the sliding pipe via a plurality of location holes on a top of said sliding pipe, wherein an opening is provided on a bottom of the roller seat, and a pair of sliding slots are respectively provided in two side sections of the roller seat and are aligned with each other;

a roller support mounted in the roller seat and fastened to said sliding pipe via at least one of said location holes on the top of said sliding pipe, wherein an opening is provided on a bottom of said roller support, and mounting holes are provided in side sections of said roller support and are aligned with said sliding slots;

a main roller engaged with a respective one of the guide tracks and including a pivot pin fastened in said mounting holes and slidably positioned within said sliding slots;

two subsidiary rollers engaged with the pair of subsidiary guide tracks, and symmetrically provided on an outside of the side sections of the roller seat and rotatable about a horizontal axis vertically aligned with a horizontal rotating axis of said main roller; and a regulator, penetrating through the top of said sliding pipe and the roller seat and pressing on a top of the roller support for adjusting a vertical separation between the main roller and the subsidiary rollers; and a hinge assembly, fastened on said sliding pipe for pivoting a respective one of the sash assemblies.

2. A window according to claim 1, wherein a pad is provided on each said sliding pipe for supporting a corresponding one of said at least two sash assemblies, each said pad comprising several holes; and a shoulder extending outwards from the pad.

3. A window according to claim 1, wherein the parallel horizontal frame portions are staggered.

4. A window according to claim 3, wherein one of said horizontal frame portions includes an outer side slab having said slant slab inclining inwardly therefrom towards said top opening.

5. A window according to claim 1, wherein each said horizontal frame section includes a slab extension provided on an inner one of said two horizontal frame portions and extends outwardly therefrom.

6. A window according to claim 5, wherein each said rail of one of said sash assemblies comprises:

a first extension, extending from an inner slab of the rail and comprising a fastening support for fastening a first strip thereto, said first strip for engaging a respective one of the slab extensions;

a second extension, extending from an outer slab of the rail and comprising a fastening support for fastening a second strip thereto, said second strip for engaging the top of an outer one of said two horizontal frame portions of a respective one of said horizontal frame sections.

7. A window according to claim 6, wherein each sash assembly includes a lap joint on a side portion of one of the stiles of said sash assembly, wherein said lap joint includes a seal for sealing the sash assemblies.

8. A window according to claim 7, wherein each sash assembly includes a fastening support provided at a side of the lap joint for protecting the lap.

9. A window according to claim 5, wherein each said rail of one of said sash assemblies comprises:

a first extension, extending from an inner slab of the rail and comprising a fastening support for fastening a first strip thereto, said first strip for engaging the slant slab of the inner one of said two horizontal frame portions of a respective one of said horizontal frame sections;

a second extension, extending from an outer slab of the rail and comprising a fastening support for fastening a second strip thereto, said second strip for engaging the top of an outer one of said two horizontal frame portions of said respective one of said horizontal frame sections.

10. A window according to claim 1, wherein a fastening support is provided on a side slab of an inner frame portion of one of said two vertical frame sections, and is configured for receiving a sealing strip.

11. A window according to claim 10, wherein a fastening support is provided on a side slab of an outer frame portion of the other of said two vertical frame sections and is configured for receiving a sealing strip.

12. A window according to claim 1, wherein said subsidiary rollers are symmetrical to each other with respect to a vertical center line of said main roller.

13. A window according to claim 1, wherein each frame section of the frame assembly includes:

a slot, arranged along the length of said frame section;

a plastic sectional material substantially matching with said frame section and including a bending projection disposed within said slot.

14. A window according to claim 13, wherein each stile and each rail includes:

a slot, arranged along the length of the stile or rail;

a plastic sectional material substantively matching with said stile or said rail and including a bending projection disposed with said slot.

15. A window according to claim 14, wherein the plastic sectional material of each stile and each rail includes a pressure element for engaging a respective one of said glass medium.

16. A window according to claim 14, wherein, a lap joint is provided on one of the stiles.

17. A window according to claim 1, wherein each said sliding pipe further includes a location device comprising:

a bolt, penetrating a location hole on the sliding pipe and extending into said sliding pipe;

a pressed-block provided at an end of the bolt and having a recess to correspond with the guide track of a respective one of the horizontal frame portions.

18. A window according to claim 1, wherein each said sash assembly includes a rotary arm assembly comprising:

a first slideway, fastened on the top of one of the sliding pipes, in which a first slide block is provided;

a second slideway, fastened to a bottom of the sash, in which a second slide block is provided;

a stand bar having a first end and a second end, wherein said first end and said second end are hinged with the first slideway and the second slide block in the second slideway, respectively;

a pivoted arm, wherein a first end and a second end of the pivoted arm are hinged with a pre-determined position on the stand bar and the first slide block in said first slideway, respectively.

19. A window according to claim 18, wherein each stand bar includes a curvilinear swell extending outwards on a pre-determined position of the stand bar in order to avoid a respective one of the hinge assemblies, and each pivoted arm comprises a bent element to be matched with a respective one of the curvilinear swells.

20. A window according to claim 18, wherein a sliding block knob is provided on the first slideway to stop the first slide block.

21. A window according to claim 1, wherein each said hinge assembly comprises a hinge sleeve provided in one of said at least two stiles of the respective one of said sash assemblies, and a rod, provided in one of the rails of the respective one of said sash assemblies.

22. A window according to claim 21, wherein each said hinge assembly also comprises:

a sleeving fastened to a predefined position on the one of said at least two stiles and configured for fastening to a top of a hinge.

23. A window according to claim 22, wherein each sash assembly includes a tension assembly provided in the other rail of said pair of rails, each tension assembly comprising:

an axial bush, located above the hinge sleeve of a respective one of said hinge assemblies and configured for receiving the hinge of the respective one of said hinge assemblies;

a pipe hoop having one end fastened with the axial bush;

a tension brace, fastened to the other one of said at least two stiles, wherein a ring is provided on an end of the brace;

a connecting piece, being fastened to another end of the pipe hoop and passing through the ring of the tension brace; and a fastener, provided on an end of the connecting piece for tightening the tension brace.

24. A window according to claim 22, wherein each sliding pipe includes an axial bush provided between said sliding pipe and said hinge sleeve for supporting the hinge sleeve.

25. A window according to claim 1, wherein one of said stiles includes an end cover having a first side and a second side, each said side including a respective recess, and said one of the stiles further includes two slabs each having a respective arris, matching with a respective one of said recesses.

26. A window according to claim 1, wherein each sash assembly includes at least one locking pin assembly provided in one of said at least two stiles, comprising:

a base frame having a keyway and;

a pin element having a cavity, a protrusion configured for being associated with an outer part of the keyway, and a body extension penetrating through a central hole on a top of the base frame;

a spring disposed in the keyway between said base frame and said pin element and engaging the protrusion of the pin element for biasing the pin element; and a movable block slidable along the cavity of the pin element and engaged with a bracing wire.

27. A window according to claim 26, wherein each sash assembly includes a handle provided in the one of said at least two stiles and engages with the locking pin assembly of the one of said at least two stiles, said handle comprising:

a platen, arranged at a predefined position on an outer surface of the one of said at least two stiles, provided with a recess provided in a front of the platen, and including a supporting seat located at an end of the recess;

a rotary handle disposed within the recess and rotatable fastened to the supporting seat utilizing an axle; and a rotary bracket engaged with the bracing wire, and fastened to the ends of the axle to be driven by the rotary handle through the axle.

28. A window according to claim 27, wherein each said handle comprises a roller fastened onto a back of the platen via a support and located below the rotary bracket.

29. A window according to claim 28, wherein in each said handle, a torsion-bar spring is provided for biasing the handle.

30. A window according to claim 26, wherein each of said one of said at least two stiles includes the locking pin assembly provided at a top thereof and another said locking pin assembly provided at a bottom thereof.

* * * * *